US008789902B2

(12) United States Patent
Hottmann et al.

(10) Patent No.: US 8,789,902 B2
(45) Date of Patent: Jul. 29, 2014

(54) INSTALLATION SYSTEM AND DOOR POSITIONING DEVICE FOR APPLIANCES

(71) Applicant: Sub-Zero, Inc., Madison, WI (US)

(72) Inventors: Philip F. Hottmann, Verona, WI (US); Mark J. Blahnik, Sun Prairie, WI (US); Chad A. Wohlrab, Madison, WI (US); John F. Andrews, Fort Atkinson, WI (US)

(73) Assignee: Sub-Zero, Inc., Madison, WI (US)

( * ) Notice: Subject to any disclaimer, the term of this patent is extended or adjusted under 35 U.S.C. 154(b) by 0 days.

(21) Appl. No.: 13/751,281

(22) Filed: Jan. 28, 2013

(65) Prior Publication Data

US 2013/0134851 A1 May 30, 2013

Related U.S. Application Data

(62) Division of application No. 12/777,139, filed on May 10, 2010, now Pat. No. 8,382,219.

(60) Provisional application No. 61/177,177, filed on May 11, 2009.

(51) Int. Cl.
*A47B 95/02* (2006.01)

(52) U.S. Cl.
USPC ..... 312/319.1; 312/348.4; 312/326

(58) Field of Classification Search
USPC ..... 312/330.1, 348.4, 265.5, 265.6, 204, 312/319.1, 402, 405, 326, 329; 49/502, 505
See application file for complete search history.

(56) References Cited

U.S. PATENT DOCUMENTS

| | | | | |
|---|---|---|---|---|
| 2,621,925 | A * | 12/1952 | Roche | 49/101 |
| 6,536,856 | B2 * | 3/2003 | Pelizzari et al. | 312/204 |
| 2008/0218043 | A1 * | 9/2008 | Gianelo | 312/319.2 |
| 2011/0266932 | A1 * | 11/2011 | Numanoglu | 312/204 |

FOREIGN PATENT DOCUMENTS

| | | | | |
|---|---|---|---|---|
| DE | 3026637 | A1 * | 2/1982 | A47B 77/08 |
| DE | 10161658 | A1 * | 6/2003 | A47L 15/42 |
| EP | 744152 | A1 * | 11/1996 | A47L 15/42 |
| EP | 1529482 | A1 * | 5/2005 | A47L 15/42 |

* cited by examiner

*Primary Examiner* — Darnell Jayne
*Assistant Examiner* — Ryan A Doyle
(74) *Attorney, Agent, or Firm* — Bell & Manning, LLC

(57) ABSTRACT

An appliance comprises a body and a door panel and/or drawer panel movable between a home position, an open position, and an over-travel position. A cosmetic panel may be coupled to the door and/or drawer panel. The appliance may further include an installation system and/or a positioning device. The positioning device is configured to bias the door and/or drawer panels to the home position from the over-travel position. The installation system is configured to establish the front-to-back alignment of the appliance. The installation system may be a direct mount installation system. The installation system may include an adjustment system configured to facilitate positioning the cosmetic panel to be co-planar with the surrounding cabinetry. The adjustment mechanism may further help establish small and consistent reveals.

28 Claims, 19 Drawing Sheets

INSTALLATION SYSTEM AND DOOR POSITIONING DEVICE FOR APPLIANCES

CROSS-REFERENCE TO RELATED APPLICATIONS

The present application is a divisional of U.S. patent application Ser. No. 12/777,139 that was filed May 10, 2010, which claims priority to U.S. Provisional Patent Application No. 61/177,177 that was filed May 11, 2009, the entire contents of which are hereby incorporated by reference.

BACKGROUND

The present invention relates generally to the field of appliances, and more specifically, to an appliance that is an integrated appliance such as an integrated refrigerator. The invention may also be adapted to built-in appliances and stand alone appliances.

Typically, the appliance is surrounded by cabinetry, other fixtures, furniture, or appliances. It may be desirable for appliances to be "integrated" with or "built into" their surrounding environment in order to diminish or obscure its presence. Cosmetic panels are used to blend an appliance into its surroundings (e.g., same/similar finish/exterior, same/similar detailing, corresponding orientation/positioning, etc.) to provide a more coherent, uniform aesthetic.

It is also desirable that reveals or clearance (e.g., distance, spaces, etc.) between the appliance (e.g., the cosmetic panel) and adjacent cabinetry are small and consistent. Similarly, it is desirable that the appliance is co-planar with the surrounding cabinetry, including having the proper front-to-back alignment/registration in its installed position.

Many known installation systems and methods have several disadvantages, including, but not limited to, insufficient blending in of the appliance with its surroundings, improper front-to-back alignment improper top-to-bottom and/or side-to side alignment with surrounding cabinetry (i.e., large and inconsistent reveals), etc.

Another disadvantage of many known installation systems and methods is the lack of ability to make adjustments to the position of a cosmetic panel relative to the doors, drawers, and other compartments and surfaces of the appliance both during installation and after installation. The initial coupling of a cosmetic panel to a door or drawer may not result in the panel being in the most desirable location relative thereto. Also, with time and use, the position of the cosmetic panels relative to the doors and/or drawers of the appliance may shift such that the appliance may no longer blend in with its surroundings as well as it once had.

Also, there are a number of disadvantages with typical door and drawer positioning devices for appliances. For example, the position of the closed door relative to the surrounding cabinetry varies depending on the speed or force used to close the door due to the flexible gasket that provides the seal. As such, the cosmetic panel may not be co-planar with the surrounding cabinetry and/or flush with the face frame of the refrigerator body.

Accordingly, it would be advantageous to provide an installation system and method that sufficiently blends an appliance into its surroundings. It would further be advantageous for this installation system and method to provide for accurate front-to-back alignment, top-to-bottom alignment, and side-to-side alignment. It would be further advantageous to provide mechanisms for making fine adjustments to the position of the cosmetic panel relative to the doors, drawers, and other compartments and surfaces of the appliance both during installation and after installation. It would also be advantageous if these mechanisms were concealed when not in use, but still quickly and easily accessible, requiring minimal or no disassembly of the appliance. It would further be advantageous to provide for establishing small and consistent reveals, both during installation and after the refrigerator has been in use. It would further be advantageous to provide an installation system and method for an appliance providing for accurate installation in a reduced amount of time. It would further be advantageous to provide a positioning device for an appliance door or drawer that over time maintains the door or drawer in a consistent position relative to the refrigerator body.

SUMMARY

One exemplary embodiment of the invention relates to an appliance that comprises a body, a first panel coupled to the body, a second panel configured to be coupled to the first panel, and an adjustment system configured to adjust the position of the second panel. The adjustment system comprises a bracket having a first side coupled to the second panel and a second side coupled to the first panel. The first panel has an aperture. The adjustment system further comprises at least one cam rotatably coupled to the first panel and at least partially located within the aperture. Rotation of the cam moves the second panel relative to the first panel.

Another exemplary embodiment of the invention relates to an appliance that comprises a body having a front surface and a panel movable relative to the body between a first position, a second position, and a third position. The third position is located between the first position and the second position. The appliance further comprises a positioning device configured to bias the panel to the third position when in the second position. The positioning device comprises a first member slidably moveable relative to a second member and a first resilient member configured to provide a biasing force to the first member and/or the second member.

Another exemplary embodiment of the invention relates to an appliance that comprises a body having a front surface and a panel movable relative to the body between a first position, a second position, and a third position. The third position is located between the first position and the second position. The appliance further comprises a positioning device configured to bias the panel to the third position when in the second position. The positioning device comprises a first member pivotally coupled to a second member at a pivot point and a first resilient member configured to provide a biasing force to the first member and/or the second member.

Another exemplary embodiment of the invention relates to an appliance that comprises a body including a front side generally opposite a rear side and a top side generally opposite a bottom side, a first panel movable relative to the body, a second panel configured to be coupled to the first panel, and a direct mount installation system for coupling the second panel to the first panel. The direct mount installation system comprises a first bracket coupled to a first side wall of the first panel. A first side of the first bracket extends laterally outward from the first side wall. The direct mount installation system further includes a second bracket coupled to a second side wall of the first panel. A first side of the second bracket extends laterally outward from the second side wall. The first sides of first bracket and the second bracket each further include a plurality of coupling features. The coupling features are spaced apart along the first sides of the first bracket and the second bracket from top to bottom.

DETAILED DESCRIPTION

Figure 1:
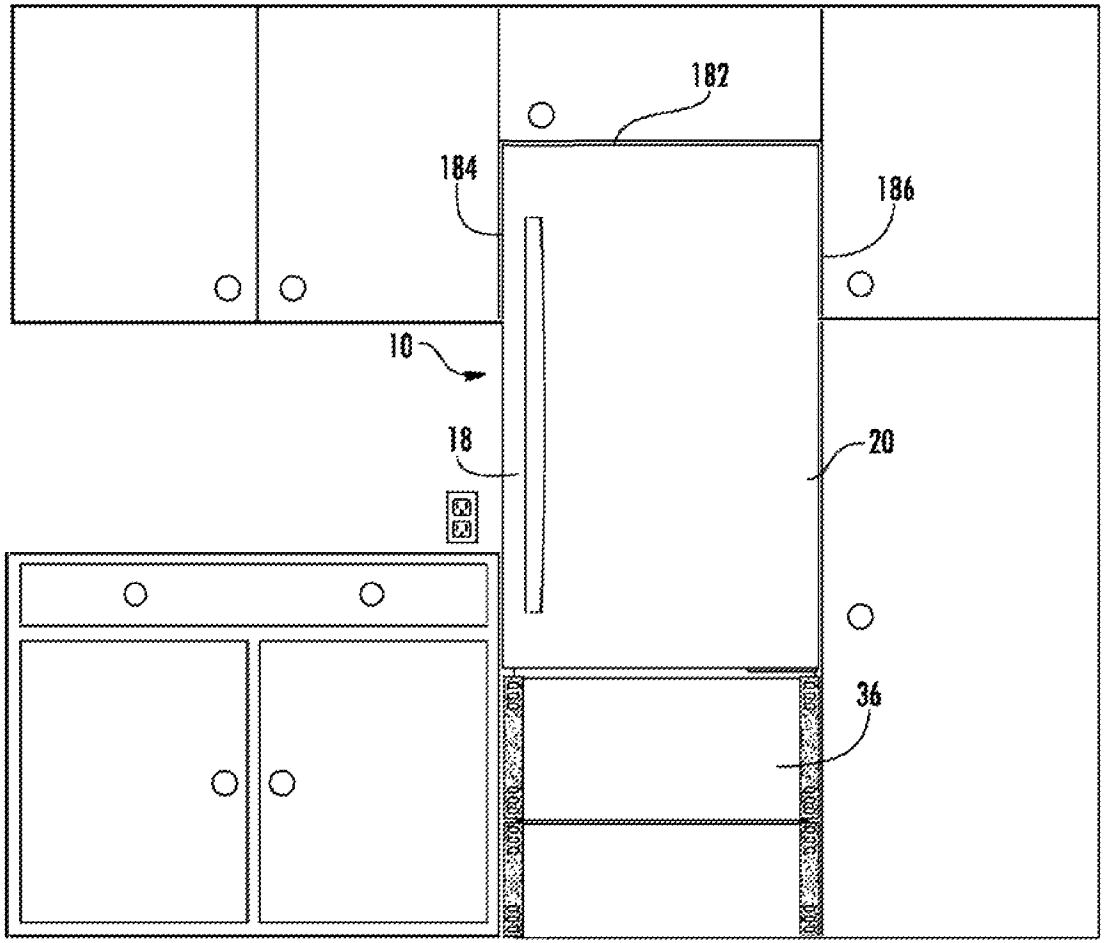
FIG. 1 is a front view of an appliance shown as a refrigerator and an installation system installed in a kitchen according to a first exemplary embodiment with the cosmetic panels removed from the drawers.

Referring to FIG. 1, a refrigerator 10 is shown according to an exemplary embodiment installed in a room shown as a kitchen. Refrigerator 10 is configured to substantially blend into its surroundings or environment, shown here as cabinetry. Alternatively, the surroundings may be furniture, a storage unit, fixtures, other appliances, etc. Such an installation is typically referred to as "built-in" or "integrated."

Refrigerator 10 includes a body 12, a door 14, a pair of drawers 16, a handle side 18, a hinge side 20, a cooling system, and various structures used to store food within cooled interior spaces. According to another exemplary embodiment, the appliance may include one or more doors and one or more drawers. According to another exemplary embodiment, the appliance may include only one or more doors. According to another exemplary embodiment, the appliance may include only one or more drawers (e.g., an under-counter appliance).

Cosmetic panels may be coupled to the door and drawers. According to an exemplary embodiment, cosmetic panels match the surrounding cabinetry (e.g., are made of the same material, have the same finish, have the same detailing, etc.). According to alternative embodiments, the cosmetic panels do not match the cabinetry and have any of a variety of stylings.

The refrigerator 10 is received in an opening, typically referred to as a rough opening, in the kitchen. In the exemplary embodiment shown, the rough opening is defined in part by the cabinetry that surrounds the refrigerator 10. At the back of the rough opening is the kitchen wall. The rough opening is generally sized to accommodate the refrigerator, leaving reveals (e.g., gaps, spaces, clearances, etc.) between refrigerator 10 and the surrounding cabinetry.

Refrigerator 10 further includes an installation system 22 and a plurality of door positioning devices 24. Installation system 22 provides for accurate and efficient installation of refrigerator 10. Installation system 22 includes a cabinet bracket 26 and an adjustment system 28. In the embodiment shown, cabinet bracket 26 provides for front-to-back alignment of refrigerator 10 within the rough opening. Further, cabinet bracket 26 is configured such that refrigerator 10 may be positioned in the rough opening, leveled (e.g., with a leveling device providing for top-to-bottom alignment of refrigerator 10), and have cosmetic panels coupled thereto before cabinet bracket 26 is coupled to the surrounding cabinetry.

Installation system 22 also provides for adjustment of the cosmetic panels relative to the cabinetry that surrounds refrigerator 10. In this manner, the desired co-planarity of the cosmetic panels with the surrounding cabinetry can be achieved. Adjustment system 28 provides for corrective or fine adjustments to the alignment and/or orientation of cosmetic panels relative to door 14 and the surrounding cabinetry. These corrective or fine adjustments may be made during installation or after installation.

Door positioning devices 24 bias door 14 to a desired position relative to body 12. When door 14 of refrigerator 10 is closed, door positioning devices 24 maintain door 14 in a position wherein door 14 is coplanar with the surrounding cabinetry. In this way, door positioning devices 24 decrease reliance on a gasket for positioning a door. More generally, it may be beneficial to decrease reliance on a gasket for positioning a door because gaskets can become compressed, crushed, and/or misshapen with use. As a result, the position of the door may vary and the door may become misaligned with its surroundings.

Figure 2:
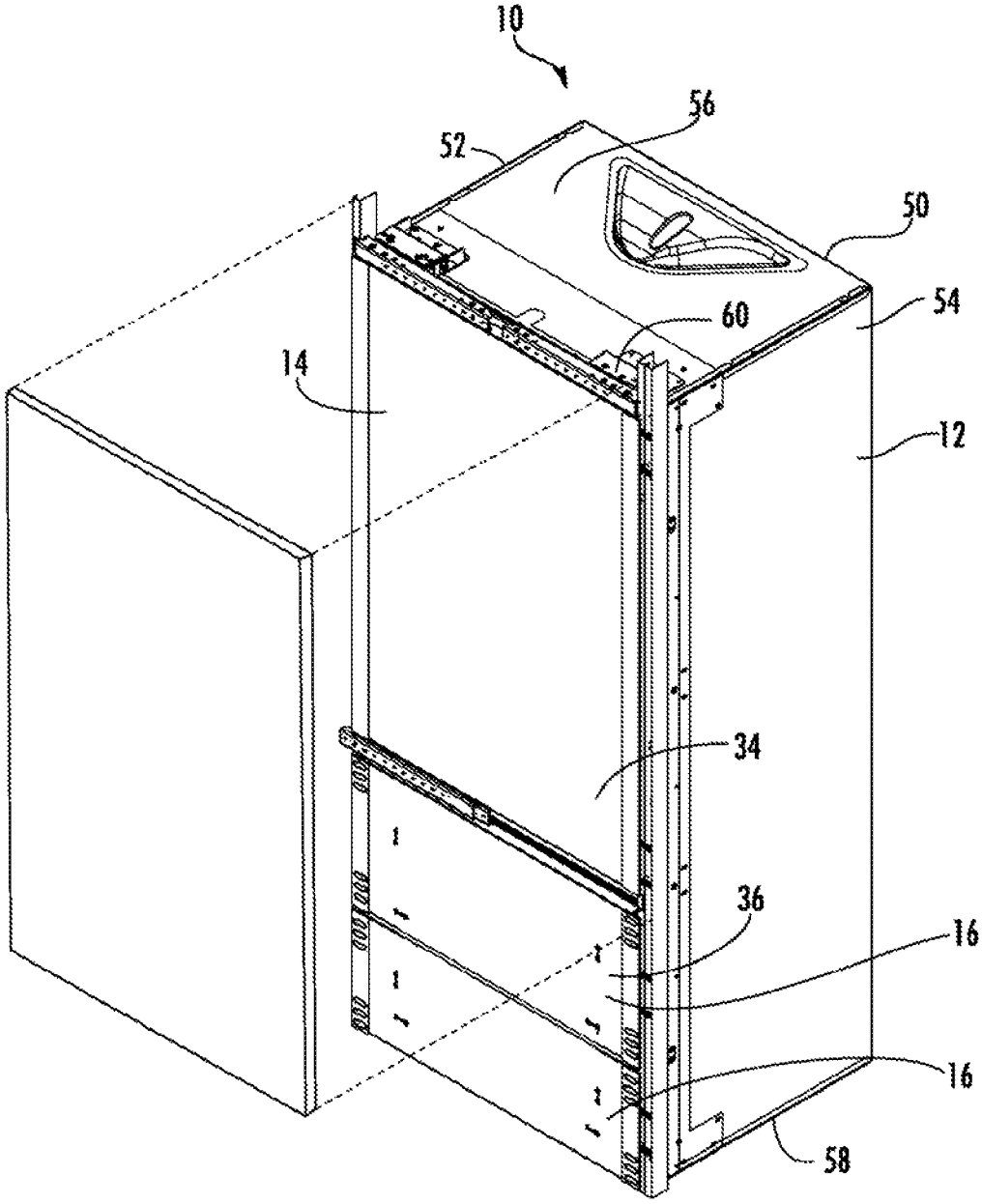
FIG. 2 is an isometric view of the refrigerator of FIG. 1.
Figure 4:
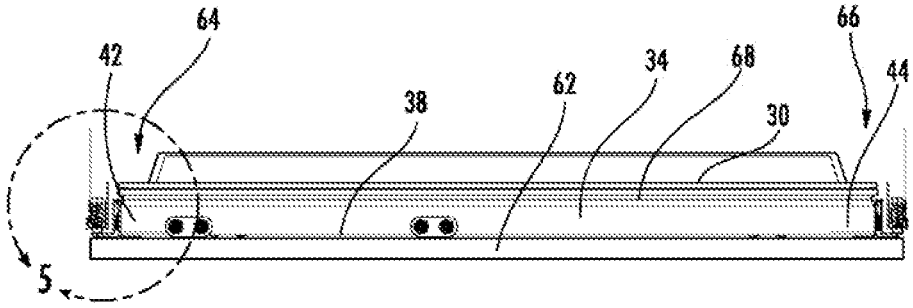
FIG. 4 is a partial top view door of the refrigerator of FIG. 1.

Referring to FIG. 2, refrigerator 10 includes body 12 and a face frame 30 at a front side 32 (see also, e.g., FIG. 4 illustrating a top view of the face frame). Refrigerator 10 further includes one or more panels, shown as door panel 34 and drawer panel 36. Door panel 34 includes a front side 38, a back or rear side, a handle side 42 opposite a hinge side 44, and a top side 46 opposite a bottom side. Body 12 (e.g., body portion, etc.) may include various wall portions, including a back or rear wall 50, opposing side walls 52, 54 and top and bottom walls 56, 58. The wall portions define interior spaces or cavities which are cooled by the cooling system. Body 12 may further include one or more intermediate walls, such as a divider wall.

Door panel 34 and drawer panels 36 are coupled to body 12. Door panel 34 and drawer panels 36 provide access to and close off the cooled interior spaces defined by body 12. In the exemplary embodiment shown, door panel 34 provides access to and closes off a refrigeration cavity, and drawer panels 36 provide access to and close off freezer cavities. Door panel 34 is movable relative to body 12. Door panel 34 is shown pivotally coupled to body 12 at hinge side 44 by one or more hinges 60. Each drawer panel 36 is also movable relative to body 12. Drawer panel 36 is slidably coupled, such that it is movable forward and backward relative to face frame 30 of body 12 while remaining substantially parallel thereto.

Refrigerator 10 is shown as a "top-bottom style" unit. According to various alternative exemplary embodiments, refrigerator 10 may comprise any of a variety of types or configurations, including, but not limited to, a "chest" style unit and a "side-by-side" style unit.

It should be understood that the exemplary embodiments and teachings disclosed herein with respect to only one of door panel 34 or drawer panels 36 are intended to extend to all door and drawer panels coupled to the body of an appliance. It should be further understood the number and arrangement of door panels and drawer panels may vary according to various exemplary embodiments of the appliance. According to yet other embodiments, the refrigerator is a drawer type appliance (e.g., refrigerator, freezer, dishwasher, etc.).

Each cosmetic panel (e.g., outer panel, surface covering members, finished surfaces, coverings, finished panel, exterior surface, decorative panel, ornamental panel, cabinetry panel, overlap panel, etc.) is coupled to a corresponding door panel or drawer panel. For example, cosmetic panel 62 is shown coupled to door panel 34 and is shown having the same material and finish as the surrounding cabinetry. Cosmetic panel 62 is shaped and sized to substantially conceal door panel 34 when viewing refrigerator 10 from the front. Referring back to FIG. 1, cosmetic panel 62 is shown co-planar with the adjacent cabinetry, defining small and consistent reveals with the adjacent cabinetry. According to other exemplary embodiments, an appliance may be provided without cosmetic panels. Please note that the different finishes of cosmetic panel 62 in FIGS. 1 and 2 merely indicate that cosmetic panels may have a variety of finishes.

Figure 3A:
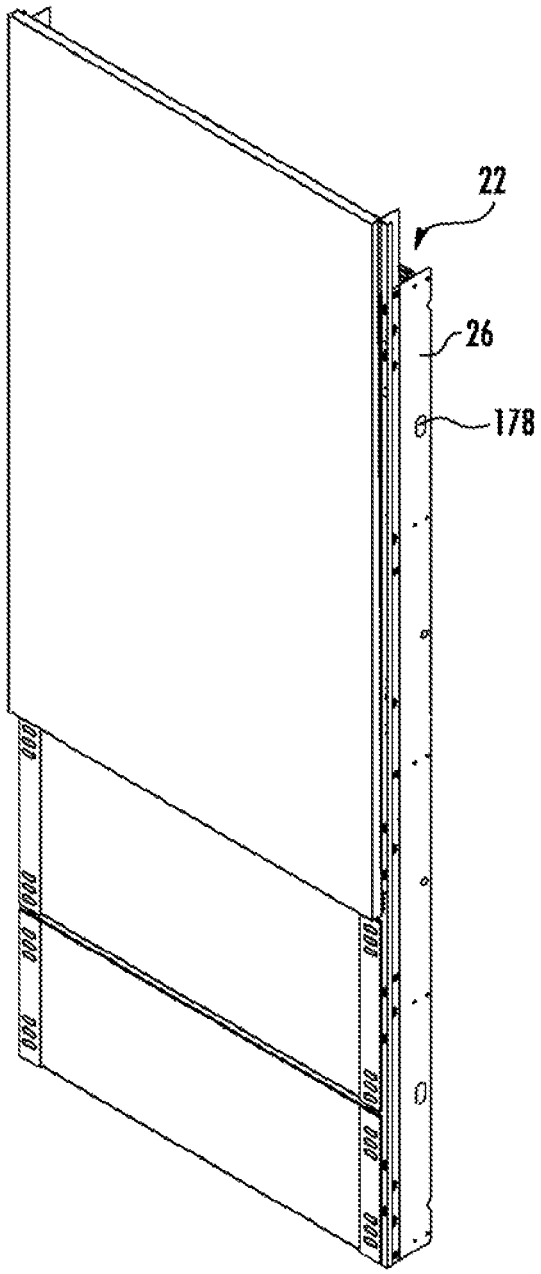
FIG. 3A is a partial front perspective view of the refrigerator of FIG. 1.
Figure 3B:
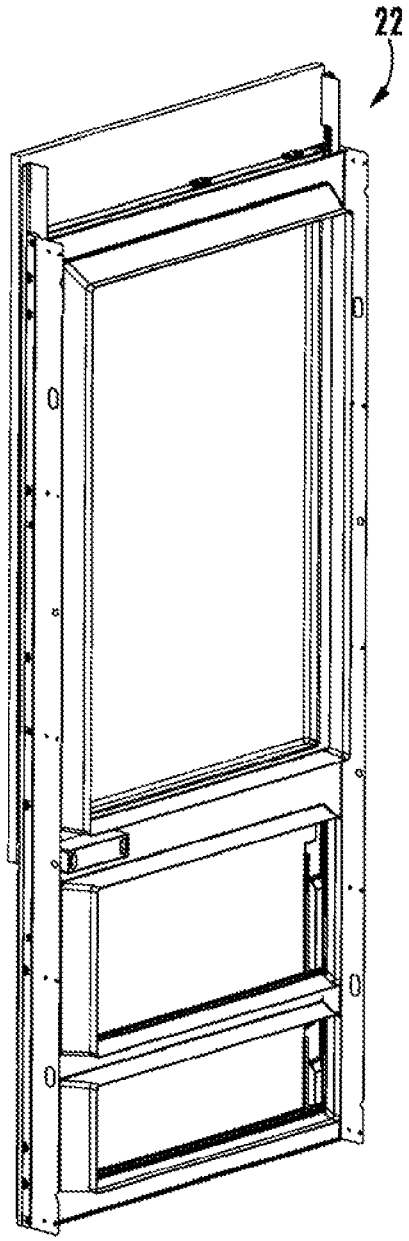
FIG. 3B is a partial rear perspective view of the refrigerator of FIG. 1

Referring to FIGS. 3A and 3B, perspective views of installation system 22 are shown according to a first exemplary embodiment.

FIG. 4 is a top view of an exemplary installation system 22, door 14, and face frame 30 of body 12. Door 14 of refrigerator 10 may include door panel 34, cosmetic panel 62, a handle side 64, and a hinge side 66. Door 14 is pivotally coupled to body 12 at hinge side 66. Handle side 64 of door 14 is a free end pivotally movable outward or forward from face frame 30 and backward or toward face frame 30. A gasket 68 is located between door 14 and face frame 30. Gasket 68 is resilient and helps maintain the seal between door 14 and body 12 of refrigerator 10. While gasket 68 is shown made of rubber, the gasket may be made of any suitable material known in the art.

Figure 5:
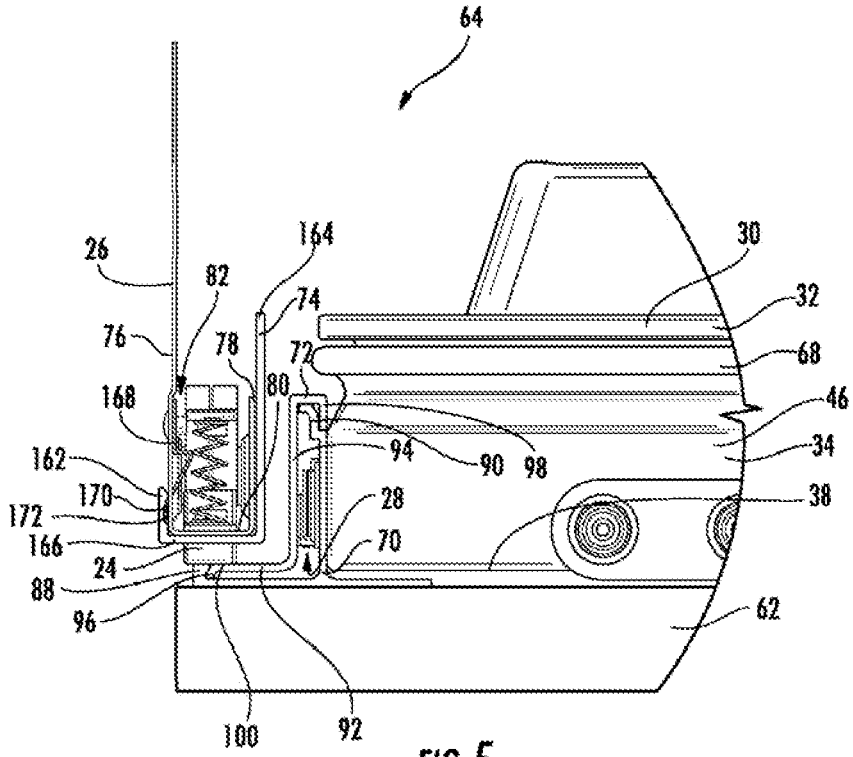
FIG. 5 is a detail view of FIG. 4 taken along the line 5.

Referring to FIG. 5, a detailed view of installation system 22 at handle side 18 of refrigerator 10 is shown including cabinet bracket 26, adjustment system 28, a first bracket 70, a second bracket 72, and a third bracket 74.

According to one exemplary embodiment, cabinet bracket 26 includes a first side 76 generally opposite and substantially parallel to a second side 78. Cabinet bracket 26 establishes the front-to-back alignment of refrigerator 10 within the rough opening. Cabinet bracket 26 is substantially fixed relative to body 12 of refrigerator 10. A front side 80 extends between first side 76 and second side 78, forming a ninety degree angle relative to each side and a substantially J-shaped front-to-back cross-section. Cabinet bracket 26 defines a vertically extending channel 82 open toward the rear of refrigerator 10. Vertically extending channel 82 is configured to receive one or more door positioning devices 24 therewithin. First side 76 of cabinet bracket 26 is configured to be coupled to a cabinet wall adjacent thereto in the rough opening, thereby coupling refrigerator 10 to the cabinet wall. The position at which cabinet bracket 26 is coupled to the adjacent cabinet wall determines the position of refrigerator 10 relative to the cabinet wall. That is, the front-to-back alignment (i.e., position, location, registration, etc.) of refrigerator 10 is related to the depth at which first side 76 of cabinet bracket 26 is coupled to the adjacent cabinet.

First bracket 70 couples door panel 34 to cosmetic panel 62 and supports cosmetic panel 62 at a desired distance/orientation relative to door panel 34. First bracket 70 includes a first side 84 and a second side 86 extending backwards from first side 84 at a right angle (i.e., perpendicular) thereto. Second side 86 of first bracket 70 is configured to be coupled to door panel 34 and moveable relative thereto. First side 84 of first bracket 70 is coupled to cosmetic panel 62 and fixed relative thereto. First side 84 of first bracket 70 is in contact with and substantially flush with a rear side 40 of cosmetic panel 62. First bracket 70 may further include a first coupling feature 88, shown extending backwards from first side 84 at the end closer to the adjacent cabinetry, and a second coupling feature 90, shown toward the back of second side 86. First coupling feature 88 and second coupling feature 90 are configured to couple first bracket 70 to second bracket 72. First bracket 70 is shown having a T-shaped front-to-back cross section, however, in other exemplary embodiments, the first bracket may be configured in any manner sufficient to couple a cosmetic panel to a door panel or drawer panel.

Further referring to FIG. 5, according to one exemplary embodiment, second bracket 72 includes a front side 92, a first side 94, a first coupling feature 96, and a second coupling feature 98. Second bracket 72 is removably coupled to first bracket 70 to at least partially conceal adjustment systems 28. First side 94 extends perpendicularly backward from the end of front side 92 farthest from the adjacent cabinet wall, forming a substantially L-shaped front-to-back cross-section. First coupling feature 96 and second coupling feature 98 of second bracket 72 are configured to be coupled with first coupling feature 88 and second coupling feature 90 of first bracket 70. Second bracket 72 is fixed relative to first bracket 70 and adjustment system 28 is at least partially concealed in a space formed therebetween. First coupling feature 88 of first bracket 70 is engaged with first coupling feature 96 of second bracket 72. Second coupling feature 90 of first bracket 70 is engaged with second coupling feature 98 of second bracket 72. A surface 100 that is substantially flat or planar is formed by first coupling feature 88 of first bracket 70 and front side 92 of second bracket 72.

Figure 6:
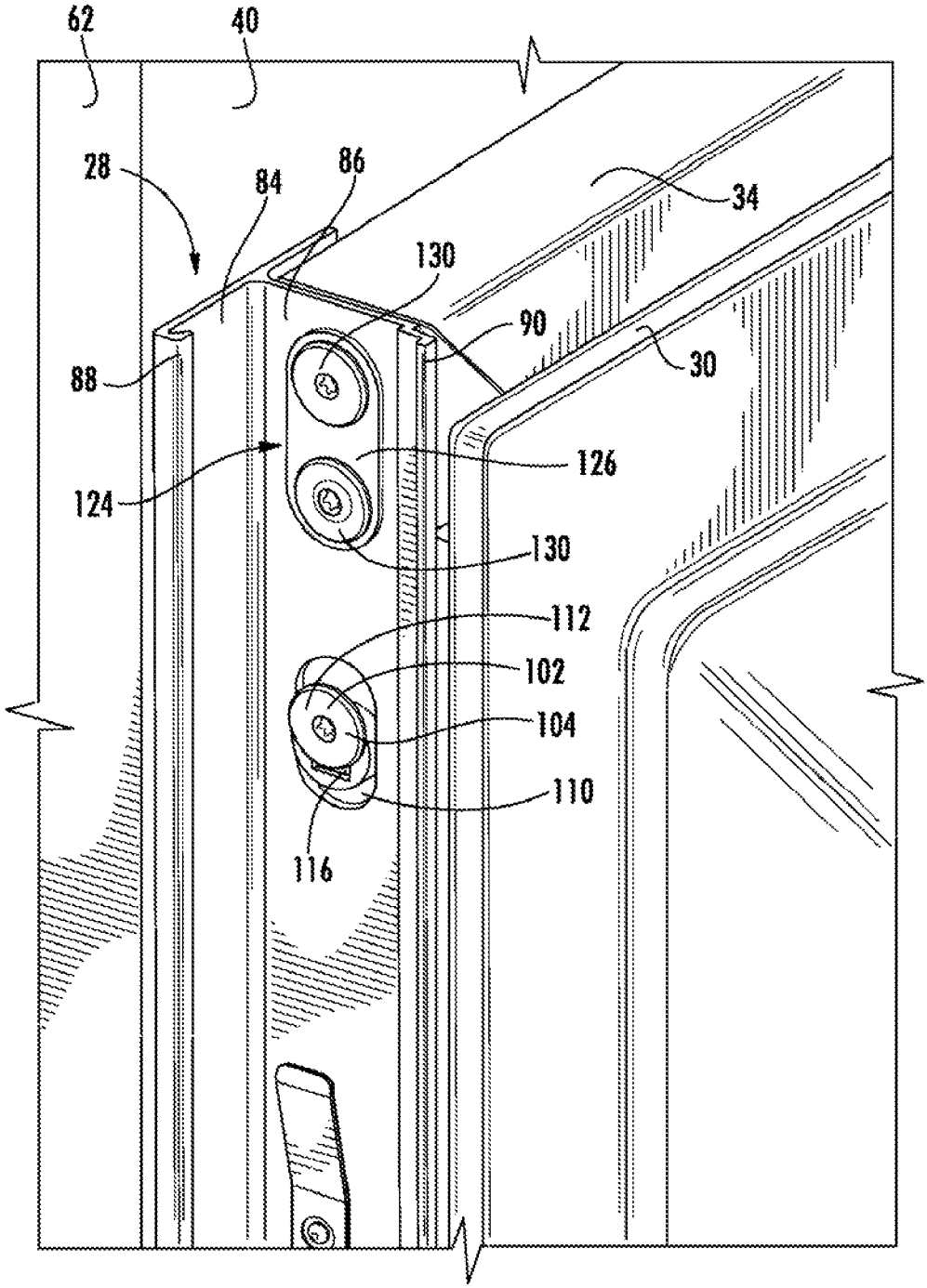
FIG. 6 is a partial perspective view of the door assembly of the refrigerator of FIG. 1.
Figure 7:
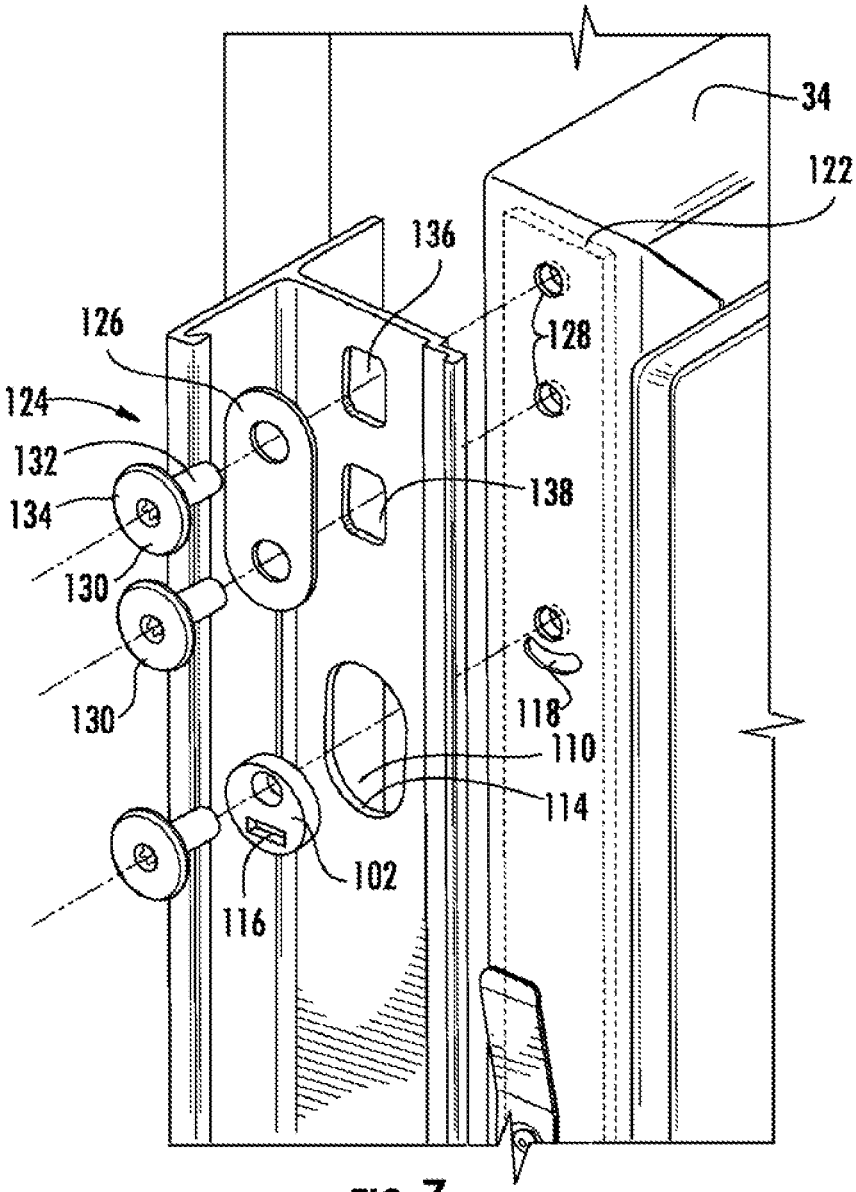
FIG. 7 is a partial exploded view of the door assembly of the refrigerator of FIG. 1.
Figure 8:
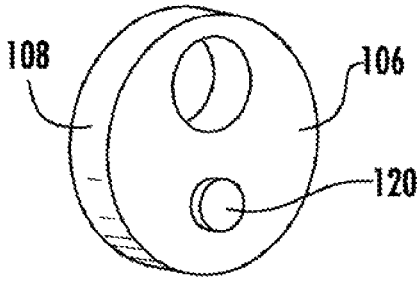
FIG. 8 is a rear view of a cam of an adjustment system of the refrigerator of FIG. 1

Referring to FIGS. 6-8, adjustment system 28 includes first bracket 70 and at least one cam 102. First bracket 70 operates as a follower to movements of cam 102 to provide desired adjustment. By rotating cam 102, the position of cosmetic panel 62 may be adjusted relative to door panel 34 for alignment with the surrounding environment. Adjustments (e.g., fine or corrective adjustments) may be made with adjustment system 28 during installation of refrigerator 10. Adjustments may also be made after installation of refrigerator 10 to account for changes in the relative position of cosmetic panel 62 and door panel 34 (e.g., due to use over time or sagging, wherein the handle side of the door being lower than the hinge side of the door, of refrigerator 10). The seal of refrigerator 10 is intended to be maintained while adjustments are made.

Rotation of cam 102 exerts a force on first bracket 70, causing first bracket 70 to move substantially forward or backward relative to door panel 34 depending on the direction of rotation. Cam 102 is a circular disk having a first side 104, a second side 106, and a peripheral wall 108 extending between first side 104 and second side 106. Cam 102 is rotatably coupled to door 14 at door panel 34 within an aperture 110 in second side 86 of first bracket 70. Cam 102 is rotatably secured within aperture 110 off-center by a fastener 112. That is, the rotational center of cam 102 is different than its physical center. Aperture 110 (e.g., slot, opening, hole, etc.) is vertically elongated and has a width that substantially corresponds with or that is larger than the diameter of cam 102. According to one exemplary embodiment, peripheral wall 108 of cam 102 has an interference fit (or at least a close fit) with an interior wall 114 defining aperture 110.

Cam 102 includes a recess 116 configured to be engaged by a tool (e.g., a flathead screwdriver, a wrench, etc.) for rotating cam 102. In the exemplary embodiment shown, clockwise rotation of cam 102 moves first bracket 70 forward, and thereby operatively moves cosmetic panel 62 forward (as cosmetic panel 62 is fixed to first bracket 70). Door panel 34 remains stationary during rotation of cam 102. Accordingly, the distance between cosmetic panel 62 and door panel 34 is increased when cam 102 is rotated clockwise (as shown in FIG. 6). Further, counterclockwise rotation of cam 102 moves first bracket 70 backward, and thereby operatively moves cosmetic panel 62 backward. Accordingly, the distance between cosmetic panel 62 and door panel 34 is decreased when cam 102 is rotated counterclockwise (as shown in FIG. 6). In this manner, cosmetic panel 62 may be aligned with the front surfaces of the adjacent cabinetry.

An arcuate aperture 118 at handle side 42 of door panel 34 guides the rotational motion of cam 102. Arcuate aperture 118 also limits the angle through which cam 102 may be rotated and the total front-to-back distance through which cosmetic panel 62 can be slidably adjusted relative to door panel 34. Second side 106 of cam 102 contacts handle side 42 of door panel 34. A protrusion 120 at second side 106 of cam 102 is received and slidable within arcuate aperture 118. Arcuate aperture 118 (curved aperture, etc.) extends substantially front to back along handle side 42 of door panel 34. By rotating cam 102 in either direction, protrusion 120 will eventually encounter an end of arcuate aperture 118, which acts as a stop, limiting the angle through which cam 102 is rotatable. Protrusion 120 contacts a plate 122 through arcuate aperture 118. Plate 122 is intended to maintain cam 102 flush with handle side 42 of door panel 34.

Adjustment system 28 further provides for vertical adjustments to the position of cosmetic panel 62. First bracket 70 may be moved vertically (i.e., top-to-bottom) relative to cam 102, thereby changing the position of cam 102 within aperture 110.

Adjustment system 28 further provides for adjustment of the planarity of cosmetic panel 62 relative to adjacent cabinetry. In the exemplary embodiment shown, adjustment system 28 includes a plurality of cams 102 spaced apart along first bracket 70 between its top and bottom. Cams 102 toward the top of first bracket 70 may be used to move first bracket 70 forward relative to door panel 34 at the top of first bracket 70 a greater distance than at the bottom of first bracket 70. In this manner, the top of cosmetic panel 62 may be tilted forward relative to the bottom of cosmetic panel 62. According to the exemplary embodiment shown, the adjustment system provides for adjustments to be made to the position of the cosmetic panel relative to the door panel about all three axes, i.e., front-to-back, vertically or top-to-bottom, and pivotally about the horizontal or side-to-side axis. According to other exemplary embodiments, however, the adjustment system may provide for adjustments to be made to the position of the cosmetic panel about any one axis or combination of axes.

Referring to FIGS. 6 and 7, refrigerator 10 may further include a plurality of securing devices 124 configured to maintain the position of cosmetic panel 62 relative to door panel 34. Securing devices 124 are tightened to maintain first bracket 70, and, accordingly, cosmetic panel 62 in a desired position. Securing devices 124 are loosened to provide for adjustment of first bracket 70, and, accordingly, cosmetic panel 62.

According to one exemplary embodiment, each securing device 124 includes a washer 126 having one or more holes 128 configured to receive fasteners 130 each having a shaft 132 and a head 134. Washer 126 is fixed relative to handle side 42 of door panel 34 by fasteners 130, which are fixed relative to door panel 34. Washer 126 is in contact with second side 86 of first bracket 70. First bracket 70 is slidably movable relative to washer 126. Apertures 136 in second side 86 of first bracket 70 extend front-to-back a distance greater than the diameter of shafts 132 of fasteners 130, providing a clearance 138. Clearance 138 is configured to provide for (e.g., permit, allow, etc.) movement of first bracket 70 relative to door panel 34. That is, first bracket 70 is moveable a distance front-to-back without fasteners 130, which are fixed relative to door panel 34, inhibiting the movement of first bracket 70 when cam 102 is rotated.

Fasteners 130 of securing device 124 are tightened to secure first bracket 70 in a desired position relative to door panel 34. Fasteners 130 exert pressure on first bracket 70, pinching first bracket 70 between washer 126 and handle side 42 of door panel 34. Generally, the tighter the securing device 124 is secured by fasteners 130, the more pressure exerted on first bracket 70 and the more friction that must be overcome to move first bracket 70. Fasteners 130 of securing device 124 are loosened to allow first bracket 70 to be moved relative to door panel 34. By loosening fasteners 130, the amount of pressure on first bracket 70 between washer 126 and handle side 42 of door panel 34 is decreased.

Securing devices 124 may resist adjustments made with adjustment system 28, allowing adjustments of first bracket 70 to be more controlled and precise. In the exemplary embodiment shown, this resistance is friction and pressure. Fasteners 130 are generally loosened to remove some pressure, but not all pressure, from first bracket 70 when moving first bracket 70 relative to door panel 34; first bracket 70 is still coupled to door panel 34 but more easily moved relative thereto. In this manner, an installer need not worry about holding up and supporting first bracket 70 relative to door panel 34 while making adjustments. Alternatively, securing device 124 may be removed from refrigerator 10 or loosened such that securing device 124 applies little to no pressure on first bracket 70 when adjustment system 28 is in use.

According to other exemplary embodiments, the installation system may include a single bracket or a plurality of brackets. According to other exemplary embodiments, the brackets may be provided as plates or other substantially elongated members. According to other exemplary embodiments, an adjustment system may not be provided in the door assembly.

Figure 9A:
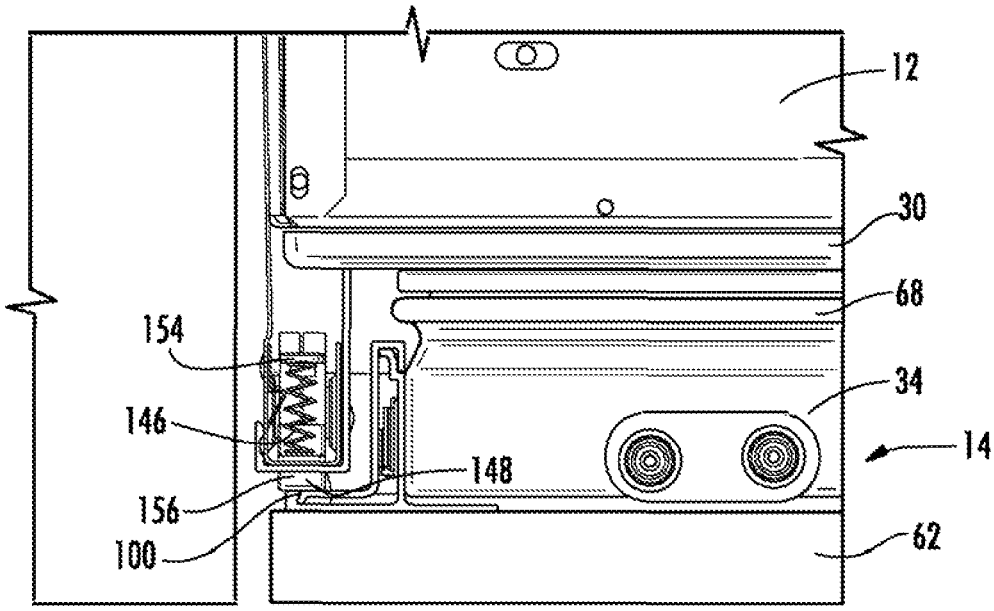
FIG. 9A is a partial top view of the refrigerator of FIG. 1 with the door in a home position.
Figure 9B:
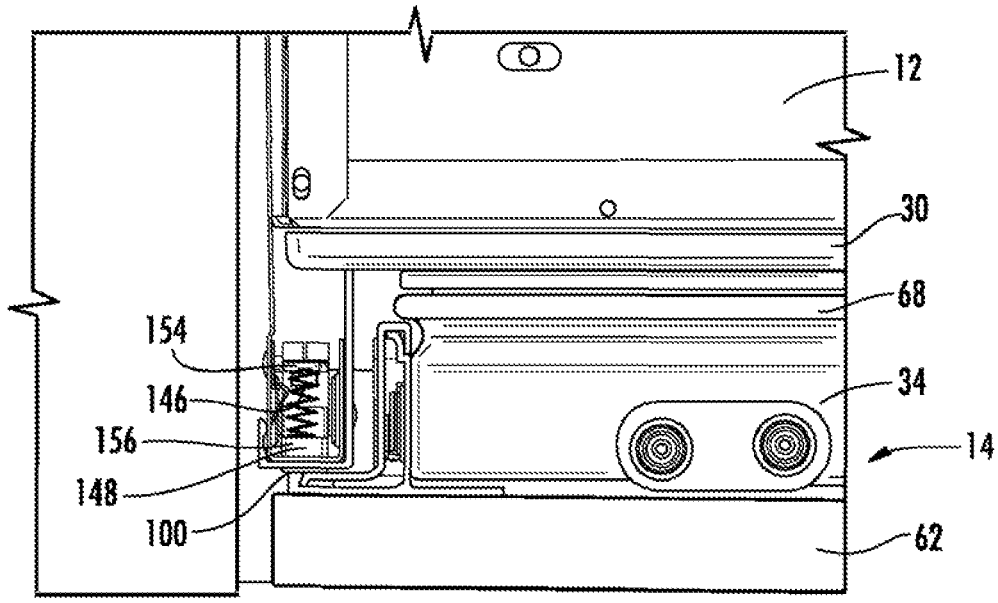
FIG. 9B is a partial top view of the refrigerator of FIG. 1 with the door in an over-travel position.

In the exemplary embodiment shown, door 14 is movable between at least a "home" position, an "over-travel" position, and an open position. Referring to FIGS. 9A and 9B, door 14 is closed in both the home position and the over-travel position. Door 14 is intended to be in the home position when closed. The home position is between the open position and the over-travel position. Referring to FIG. 9A, in the home position, door 14 is substantially parallel to face frame 30, in contact with gasket 68, and substantially co-planar with the adjacent cabinet. Referring to FIG. 9B, in the over-travel position, door 14 is no longer co-planar with the adjacent cabinet. Rather, door 14 in the over-travel position is angled toward face frame 30 of body 12 relative to door 14 in the home position. Also, gasket 68 is compressed (e.g., over or super compressed) a greater distance by door 14 in the over-travel position than in the home position. In the open position, handle side 42 of door 14 is pivotally moved away from body 12, and door 14 is angled away from face frame 30 of body 12 relative to door 14 in the home position.

Figure 9C:
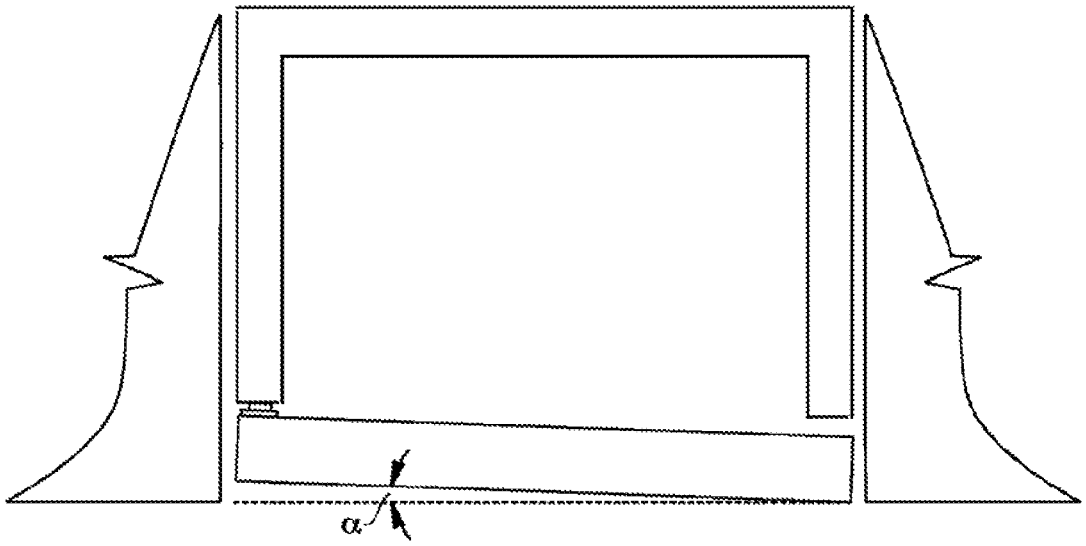
FIG. 9C is a schematic view of a refrigerator similar to the refrigerator of FIG. 9B indicating the position of a door when in the over-travel position.

FIG. 9C provides another illustration of a refrigerator door in an over-travel position. That is, the refrigerator door in FIG. 9C is angled toward the face frame or front surface of the body of the refrigerator relative to the refrigerator door in its home position. The angle through which the refrigerator door has moved beyond the home position is labeled .alpha.

Figure 10:
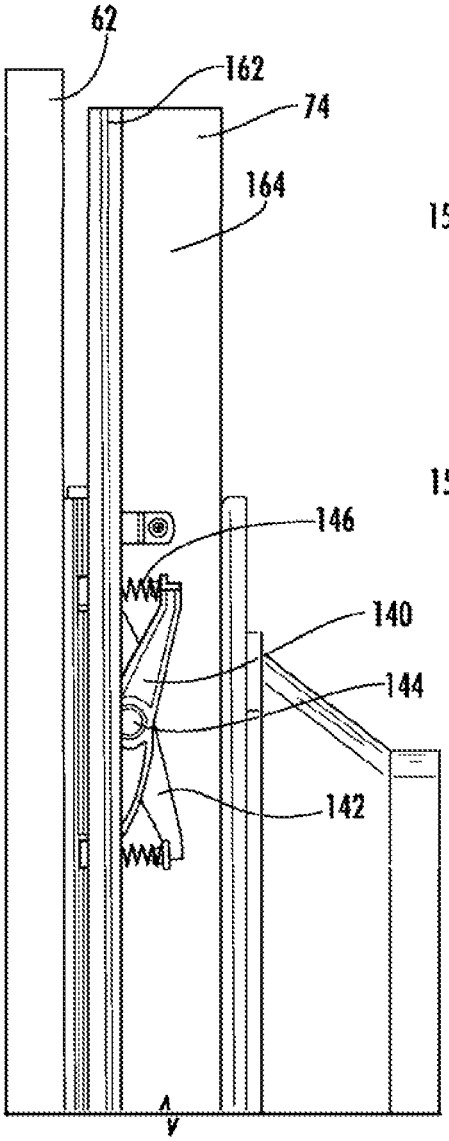
FIG. 10 is a partial side view of the refrigerator of FIG. 1.
Figure 11:
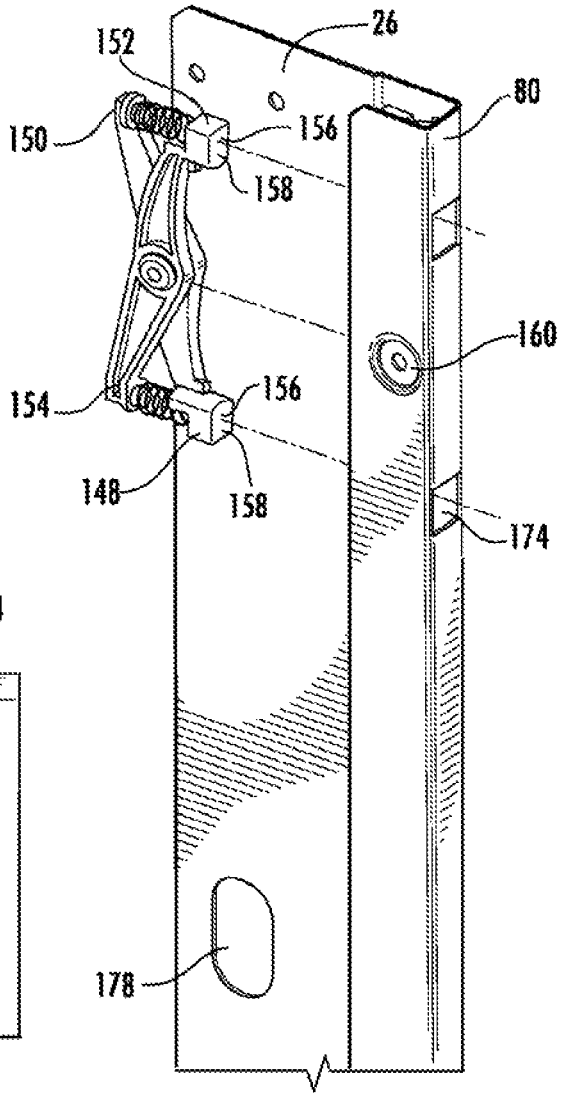
FIG. 11 is a partial exploded view of the installation system and door positioning device of the refrigerator of FIG. 1.

Referring to FIGS. 10 and 11, an exemplary embodiment of door positioning device 24 is shown. Door positioning device 24 includes a first member 140 and a second member 142 pivotally coupled at a pivot 144, and a first resilient member and a second resilient member shown as springs such as compression springs 146. Door positioning device 24 is configured to allow door 14 to move to the over-travel position. Accordingly, when door 14 is closed with more force than necessary (e.g., slammed), door 14 does not face a hard stop against body 12. Generally, one or more door positioning devices are located along the handle side of a door panel, to account for over-travel of the door and compression of the gasket. One or more door positioning devices are located along both sides of a drawer panel, to account for over-travel of the door and compression of the gasket.

Door positioning device 24 is further configured to bias (i.e., push, force, etc.) door 14 to the home position from the over-travel position. Compression springs 146 are designed to have a certain spring force to bias door 14 to the home position from the over traveled position. Thus, the positioning device may operate as a control feature to avoid the unpredictability of relying solely on a gasket for establishing a home position for an appliance door. It should be noted that the gasket may be a magnetic gasket.

In the exemplary embodiment shown, pivot point 144 is centrally located between a first end 148 and a second end 150 of first member 140 and a first end 152 and a second end 154 of second member 142. First end 148 of first member 140 is substantially aligned front-to-back with second end 154 of second member 142, one compression spring 146 extending therebetween. First end 152 of second member 142 is substantially aligned front-to-back with second end 150 of first member 140, another compression spring 146 extending therebetween. First ends of first member 140 and second member 142 include contact portions shown as pads 156 configured to operatively contact door 14. In the exemplary embodiment shown, pads 156 (i.e., spacers, protrusions, etc.) include a front surface 158 that is substantially flat or planar.

Referring to FIG. 10, door positioning devices 24 are received and concealed by cabinet bracket 26, providing refrigerator 10 with an improved aesthetic. Door positioning device 24 is shown pivotally coupled to cabinet bracket 26 at a pair of pivot receiving features 160. Pivot 144 is fixed relative to cabinet bracket 26, and, accordingly, substantially fixed relative to body 12. Further, the location of each door positioning device 24 relative to top wall 56 and bottom wall 58 of body 12 of refrigerator 10 is substantially fixed because cabinet bracket 26 is substantially fixed relative to body 12.

Door positioning device 24 is received within vertically extending channel 82 of cabinet bracket 26. First ends of first member 140 and second member 142 are closer to the front side of refrigerator 10 than second ends of first member 140 and second member 142. Further, first end 148 of first member 140 is generally vertically aligned with first end 152 of second member 142, and second end 150 of first member 140 is generally vertically aligned with second end 154 of second member 142.

Door positioning devices 24 may be further received and concealed by third bracket 74. Cabinet bracket 26 is configured to be received between a first side 162 and a second side 164 of third bracket 74. First side 162 of third bracket 74 is opposite and substantially parallel to second side 164. A front side 166 extends between first side 162 and second side 164, forming a ninety degree angle relative to each side and a J-shaped front-to-back cross-section. Front sides, first sides, and second sides of cabinet bracket 26 and third bracket 74 are substantially aligned and in contact. Third bracket 74 is coupled to body 12 of refrigerator 10. In the exemplary embodiment shown, third bracket 74 is fixed relative to cabinet bracket 26 and both brackets are coupled to body 12 of refrigerator 10.

Referring back to FIG. 5, one or more coupling mechanisms shown as a spring clips 168 are provided to couple cabinet bracket 26 relative to third bracket 74. Spring clips 168 are coupled to cabinet bracket 26. Front side 80 of cabinet bracket 26 may then be pushed into third bracket 74 toward front side 166 of third bracket 74. As front side 80 of cabinet bracket 26 moves toward front side 166 of third bracket 74, a front portion 170 of spring clip 168 aligns with one of first side 162 and second side 164 of third bracket 74 and catches at a depression 172 in cabinet bracket 26.

Referring back to FIGS. 9A and 9B, front surfaces 158 of pads 156 (i.e., spacers, protrusions, etc.) operably contact door 14 at surface 100. Cabinet bracket 26 includes a plurality of apertures 174 at front side 80 that allow pads 156 of door positioning device 24 to extend forward therethrough. Third bracket 74 also includes a plurality of apertures in locations corresponding to those of apertures 174 of cabinet bracket 26. The apertures of third bracket 74 are aligned with apertures 174 and allow pads 156 of door positioning device 24 to extend therethrough.

Refrigerator 10 is configured to not rely on gasket 68 to maintain door 14 in a desired position. In FIG. 9A, door 14 is shown in the home position. In the home position at handle side 42 of door panel 34, pads 156 extend through apertures 174 to operatively contact door 14. Compression springs 146 are compressed a first distance because of the force of door 14 against pads 156. In FIG. 9B, door 14 is shown in the over-travel position. In the over-travel position, door 14 forces pads 156 back toward back wall 50 of body 12. Accordingly, pads 156 do not extend as far forward through apertures 174 as in the over-travel position as in the home position. Compression springs 146 are compressed a second distance greater than the first distance compression springs 146 are compressed in the home position. Accordingly, compression springs 146 exert more force on door 14 in the over-travel position, biasing door 14 forward or outward to the home position. In addition to avoiding damage to refrigerator 10, the dampening effect created by of door positioning device 24 conveys a higher quality to a user.

Referring to FIG. 9A, first end 148 of first member 140 is a first distance from second end 154 of second member 142, and first end 152 of second member 142 is a first distance from second end 150 of first member 140. Referring to FIG. 9B, first end 148 of first member 140 is a second distance from second end 154 of second member 142 and first end 152 of second member 142 is a second distance from second end 150 of first member 140. The second distance is smaller than the first distance. That is, in the over-travel position, first end 148 of first member 140 is closer to the second end 154 of second member 142 in the over-travel position than in the home position, and the first end 152 of second member 142 is closer to second end 150 of first member 140 in the over-travel position than in the home position.

Both adjustment system 28 and door positioning device 24 are substantially concealed when refrigerator 10 is installed. According to the exemplary embodiment shown, cabinet bracket 26, first bracket 70, second bracket 72, and third bracket 74 of installation system 22 substantially conceal adjustment systems 28 and door positioning devices 24 when door 14 of refrigerator 10 is in the home position, the open position, and the over travel position. In other exemplary embodiments, the installation system may have additional components configured to conceal the adjustment system, the positioning device, and any other device/system/component that it is desirable to conceal. In this manner, refrigerator 10 further conveys a higher quality and better aesthetic.

It should be noted that, in accordance with this disclosure, other exemplary embodiments include appliances having any combination of one or more of the above-disclosed advantages and/or functionalities.

Referring generally to the FIGURES, the installation of refrigerator 10 will now be discussed. In the exemplary embodiment shown, before installation, door 14 and body 12 of refrigerator 10 are already coupled (e.g., at the factory). Further, installation system 22 and door positioning devices 24 are already coupled to body 12.

One or more positioning indicators may be provided along the cabinet walls to facilitate coupling cabinet bracket 26 to the cabinet wall at a location establishing the desired front-to-back alignment of refrigerator 10. A gauge may be used to ensure the desired plane is established. Positioning indicators are put in place before refrigerator 10 is positioned in the rough opening. A plurality of elongated apertures 178 of cabinet bracket 26 substantially correspond to positioning indicators. When refrigerator 10 is positioned in the rough opening, elongated apertures 178 of cabinet bracket 26 are aligned with positioning indicators to align refrigerator 10 along the adjacent wall of the rough opening. Positioning indicators may be pre-drilled holes (e.g., pilot holes), surface markings, or any other marking configured to facilitate aligning the cabinet bracket within a rough opening. According to one exemplary embodiment, positioning indicators are provided on both the hinge side and the handle side of the refrigerator. According to another exemplary embodiment, positioning indicators are provided on one of the hinge side and the handle side of the refrigerator.

Refrigerator 10 is positioned in the rough opening. After positioning refrigerator 10 in the rough opening, cosmetic panels are coupled to door panel 34 and drawer panels 36. By way of example, but not by way of limitation, the coupling of cosmetic panel 62 to door panel 34 will be discussed.

Adjustments to the position of refrigerator 10 and cosmetic panel 62 are made to establish small and consistent reveals between cosmetic panel 62 and the surrounding cabinetry. From the perspective of a person facing refrigerator 10 from the front, a top reveal 182 is between the top cosmetic panel 62 of refrigerator 10 and the adjacent upper cabinet. A handle side reveal 184 and a hinge side reveal 186 are also shown. Handle side reveal 184 is between the handle side of cosmetic panel 62 of refrigerator 10 and the cabinet adjacent to that side. Hinge side reveal 186 is between the hinge side of refrigerator 10 and the cabinet adjacent to that side.

To couple the cosmetic panel to the door panel, tabbed portions of the mounting bracket on the handle side of the cosmetic panel engage one or more positioning screws on the handle side of the door panel. Similarly, the mounting bracket on the hinge side of the cosmetic panel is slid onto one or more positioning screws on the hinge side of the door panel. The positioning screws support the cosmetic panel during installation and adjustment. The cosmetic panel may then be adjusted side-to-side and up-and-down relative to the door panel. Finally, fasteners secure the cosmetic panel to the door panel in its desired position relative to the door panel and the surrounding environment. The marking and drilling template may be used to mount cosmetic panels to both door panels and drawer panels.

One or more leveling mechanisms may be used to adjust top reveal 182 so that it is small and consistent. In the exemplary embodiment shown, leveling mechanisms may be provided at bottom wall 58 of body 12. In other exemplary embodiments, leveling mechanisms may be in any location or have any configuration sufficient to level refrigerator 10 and establish the desired top reveal.

Cabinet bracket 26 may then be coupled (e.g., mounted, secured, fastened, etc.) to the vertically extending cabinet walls adjacent to handle side 18 and hinge side 20 of refrigerator 10. As discussed above, there is generally one cabinet bracket 26 at each of handle side 18 and hinge side 20 of refrigerator 10. Elongated apertures 178 of cabinet bracket 26 are aligned with positioning indicators. Elongated apertures 178 then receive fasteners to couple cabinet bracket 26 to the adjacent cabinet walls. Fasteners extend from inside body 12, through cabinet bracket 26 into the adjacent cabinetry. Elongated apertures 178 compensate for manufacturing tolerance stack-up. That is, elongated apertures 178 may avoid the need for precise alignment between cabinet bracket 26 and the adjacent cabinetry without compromising the alignment of the refrigerator. Elongated apertures 178 may be elongated vertically (i.e., between the top and bottom of refrigerator 10) or elongated horizontally (i.e., between the front and back of refrigerator 10).

In another exemplary embodiments, fasteners may extend from the side of the cabinet wall distal or opposite to the refrigerator, through cabinet bracket 26, and into body 12. In other exemplary embodiments, refrigerator 10 may be adjacent to another appliance at either handle side or hinge side. Refrigerator 10 is couplable to an adjacent appliance such that their front surfaces are co-planar. According to some exemplary embodiments, a fourth bracket may be provided to couple the refrigerator to the appliance. For example, the fourth bracket may be a mirror image of the third bracket and coupled to the third bracket.

Adjustment system 28 is then used to provide for adjustments, e.g., fine adjustments, to the position/orientation of cosmetic panel 62. In this manner, cosmetic panel 62 may be adjusted such that it is co-planar with the surrounding cabinetry and such that the reveals are small and consistent. Adjustment system 28 is quickly and easily accessible by opening door 14 and removing second bracket 72. As discussed above, this accessibility enables adjustment system 28 to be used to make adjustments at any time during the life of the refrigerator.

Referring to FIGS. 12-19, a second exemplary embodiment of a refrigerator 310 is shown including a body 312, a door 314, and a pair of drawers 316 according to an exemplary embodiment. Door 314 includes a handle side 322 substantially opposite a hinge side 320. Body 312 includes a front side 324 generally opposite a rear side 326 and a face frame 328 at front side 324.

Refrigerator 310 further includes a direct mount installation system 330, one or more drawer positioning devices 334, and one or more door positioning devices 336 according to an exemplary embodiment.

Figure 13:
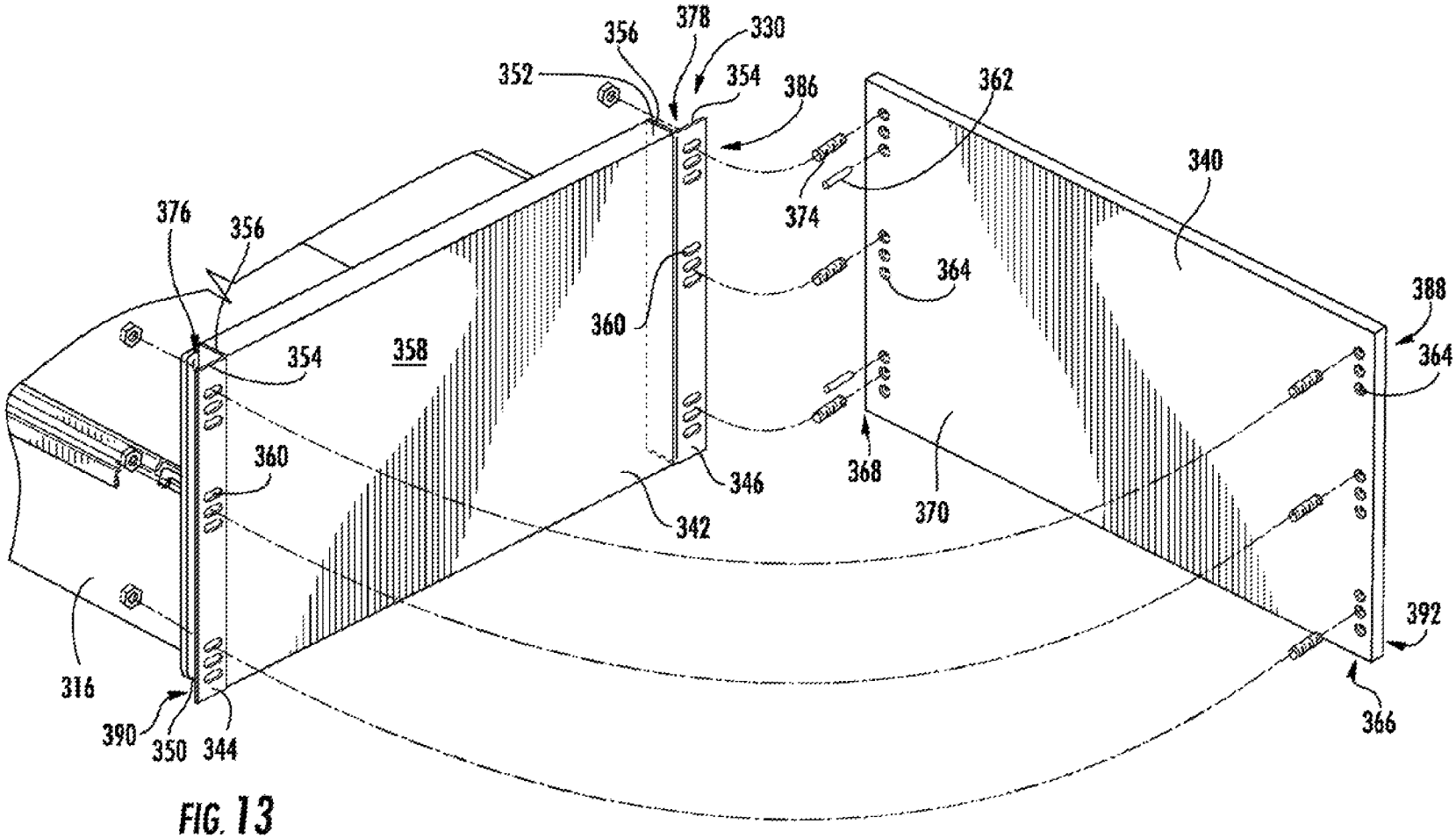
FIG. 13 is a partial perspective view of a drawer of the refrigerator of FIG. 12 having the corresponding cosmetic panel exploded therefrom.
Figure 14:
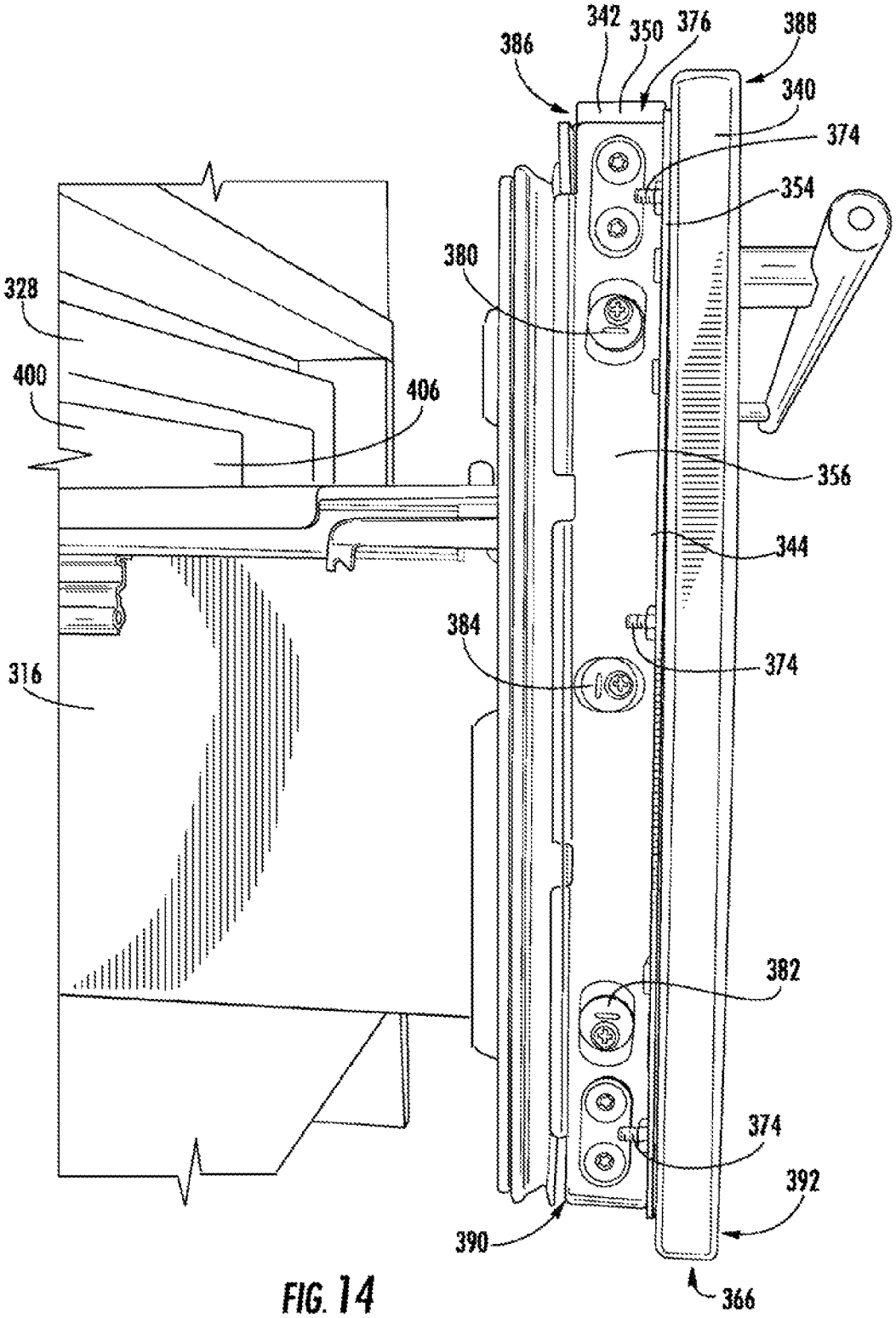
FIG. 14 is a partial side perspective view of the drawer of the refrigerator of FIG. 12.

FIGS. 13-14 show direct mount installation system 330 utilized with drawers 316 to provide for accurate and efficient coupling of a cosmetic panel 340 (e.g., stainless steel, oak, etc.) relative to a drawer panel 342. Direct mount installation system 330 includes a plurality of brackets, shown as a first bracket 344 and a second bracket 346, that are configured to support cosmetic panel 340 relative to drawer panel 342. Brackets 344, 346 need not be removed from drawer 316 in order to install cosmetic panel 340; rather, cosmetic panel 340 can be directly mounted to brackets 344, 346 while brackets 344, 346 remain coupled to drawer 316. Further, with direct mount installation system 330, a person can position and couple cosmetic panel 340 relative to drawer panel 342 by themselves, saving the cost and time associated with utilizing two or more people for such an installation. While the direct mount installation system is shown utilized with drawers, it should be noted that the direct mount installation system or features thereof may be utilized with other elements that are moveable to provide access to a space (e.g., a door, etc.). According to some exemplary embodiments, the brackets are coupled to the drawer panel before installation (e.g., at the factory).

Referring to FIG. 13, first bracket 344 is coupled to a first side wall 350 of drawer panel 342, and second bracket 346 is coupled to a second side wall 352 of drawer panel 342 according to an exemplary embodiment. Brackets 344, 346 are each shown substantially L-shaped, including at least a first side 354 and a second side 356. First side 354 of the first bracket 344 is generally aligned with and extends a distance laterally outward from a front surface 358 of the drawer panel 342. Similarly, first side 354 of second bracket 346 is generally aligned with and extends a distance laterally outward from front surface 358 of drawer panel 342. Second sides 356 of first bracket 344 and second bracket 346 are disposed adjacent and generally parallel to side walls 350, 352, respectively. In the illustrated embodiment, second side 356 of first bracket 344 is shown mounted to first side wall 350, and second side 356 of second bracket 346 is shown mounted to second side wall 352. In other exemplary embodiments, the brackets may be mounted in any suitable manner relative to the drawer panel or other elements of the drawer. Also, while the brackets are each shown substantially L-shaped, the bracket may have any shape suitable for providing for direct mount installation as described herein.

Referring further to FIG. 13, first bracket 344 and second bracket 346 each further include a plurality of coupling features, shown as apertures 360, spaced apart along their respective first sides 354 generally vertically (i.e., from top-to-bottom) according to an exemplary embodiment. Apertures 360 are configured to receive one or more support features and/or fastening elements when positioning and coupling cosmetic panel 340 relative to drawer panel 342.

According to an exemplary method of installing the cosmetic panel, cosmetic panel 340 is supported in a desired position relative to drawer panel 342 by one or more support elements, shown as pins 362. Each pin 362 is positioned in an aperture 364 at a rear side of cosmetic panel 340. Apertures 364 are shown spaced apart between the top and the bottom of a first side 366 and a second side 368 of cosmetic panel 340. Typically, pins 362 are positioned in apertures 364 at each of first side 366 and second side 368. In these positions, the pins 362 extend a distance rearward of a rear side 370 of cosmetic panel 340 and can be positioned in apertures 360 of first bracket 344 and second bracket 346 according to an exemplary embodiment. In this way, the positions of pins 362 relative to cosmetic panel 340 and drawer panel 342 establish the general top-to-bottom alignment between cosmetic panel 340 and drawer panel 342. Further, by maintaining cosmetic panel 340 in this desired position relative to drawer panel 342, pins 362 facilitate coupling of cosmetic panel 340 to drawer panel 342 (e.g., once pins 362 are in place and support the cosmetic panel 340 relative to the drawer panel, a person may have both arms free to continue with the installation). It should be noted that the support elements may be elements other than pins that are suitable for supporting the cosmetic panel relative to the drawer panel (e.g., screws, hooks, projections, etc.) to facilitate coupling. In some exemplary embodiments, the support elements may be integrally formed or fixed relative to one or both of the cosmetic panel and the drawer panel.

Referring further to FIG. 13, the apertures of one or more of the cosmetic panels and the brackets may be sized and shaped to allow for additional control over the positioning of cosmetic panel 340 relative to drawer panel 342. According to the exemplary embodiment shown, apertures 360 of brackets 344, 346 extend a distance laterally. Pins 362 may be moved laterally within apertures 360 to change the lateral position of cosmetic panel 340 relative to drawer panel 342, allowing for more accurate alignment of the cosmetic panel with its surroundings to be achieved.

While cosmetic panel 340 is substantially supported/maintained in a desired position relative to drawer panel 342 by pins 362, a person may utilize one or more fasteners to substantially secure cosmetic panel 340 relative to first bracket 344 and second bracket 346. In the exemplary embodiment shown, the one or more fasteners are shown as threaded screws 374 and apertures 364 of cosmetic panel 340 are threaded. Screws 374 are positioned through aperture 360 of one of brackets 344, 346, into an aperture 364 of cosmetic panel 340, and then rotated to secure cosmetic panel 340 to the bracket. According to other exemplary embodiments, other fasteners and/or suitable receiving features may be used.

Referring to FIGS. 13-14, before or after installation of the cosmetic panel, a pair of adjustment systems 376, 378, similar to adjustment system 28, may be used to adjust the position of one or both of brackets 344, 346 relative to drawer panel 342. While the position of the brackets may be adjusted before or after securing the cosmetic panel thereto, the ability to adjust the position of the brackets 344, 346 relative to the drawer panel 342 is particularly useful after cosmetic panel 340 has been secured to brackets 344, 346 as a person can "fine tune" the position of the cosmetic panel relative to it surroundings and relative to the drawer panel.

Referring to FIG. 14, the first adjustment system 376 is shown positioned at first side wall 350 of drawer 316 and is operable with first bracket 344; the second adjustment system 378 is shown positioned at second side wall 352 of drawer 316 and operable with second bracket 346 (see e.g., FIG. 13 showing the second adjustment system 378). Each adjustment system 376, 378 is includes a first cam 380, a second cam 382, and a third cam 384 according to an exemplary embodiment. Cams 380, 382, 384 are similar to cam 102 of adjustment system 28. That is, the cams 380, 382, 384 are movable, and the brackets 344, 346 operate as followers to movements of cams 380, 382, 384 to provide a desired adjustment.

Referring further to FIG. 14, at either side, cams 380, 382, 384 are spaced apart along second sides 356 of their corresponding bracket 344, 346 generally from top to bottom. In each adjustment system, first cam 380 is disposed proximate to a first or upper end 386 of drawer panel 342. Rotation of first cam 380 operably moves a first or upper end 388 of cosmetic panel 340 toward and away from drawer panel 342 (e.g., generally front-to-back). Second cam 382 is disposed proximate to a second or lower end 390 of drawer panel 342. Rotation of second cam 382 operably moves a second or lower end 392 of cosmetic panel 340 toward and away from drawer panel 342 (e.g., generally front-to-back). Third cam 384 is disposed substantially between first cam 380 and second cam 382. Rotation of third cam 384 operably moves cosmetic panel 340 up and down, in a direction generally parallel to front surface 358 of drawer panel 342. Accordingly, similar to adjustment system 28, first and second adjustment systems 376, 378 provide for vertical adjustment of the cosmetic panel 340 relative to drawer panel 342 and provide for adjustment of the planarity of the cosmetic panel 340 relative to the surroundings (e.g., cabinetry, etc.). It should be noted that an adjustment system may include any number of brackets and or cams (e.g., a number suitable for the appliance, the structure of the appliance, etc.).

Referring to FIGS. 15-19*b*, drawer positioning devices 334 and door positioning devices 336 are configured to bias a door or drawer to the home position from the over travel position similar to positioning devices 24.

Figure 15:
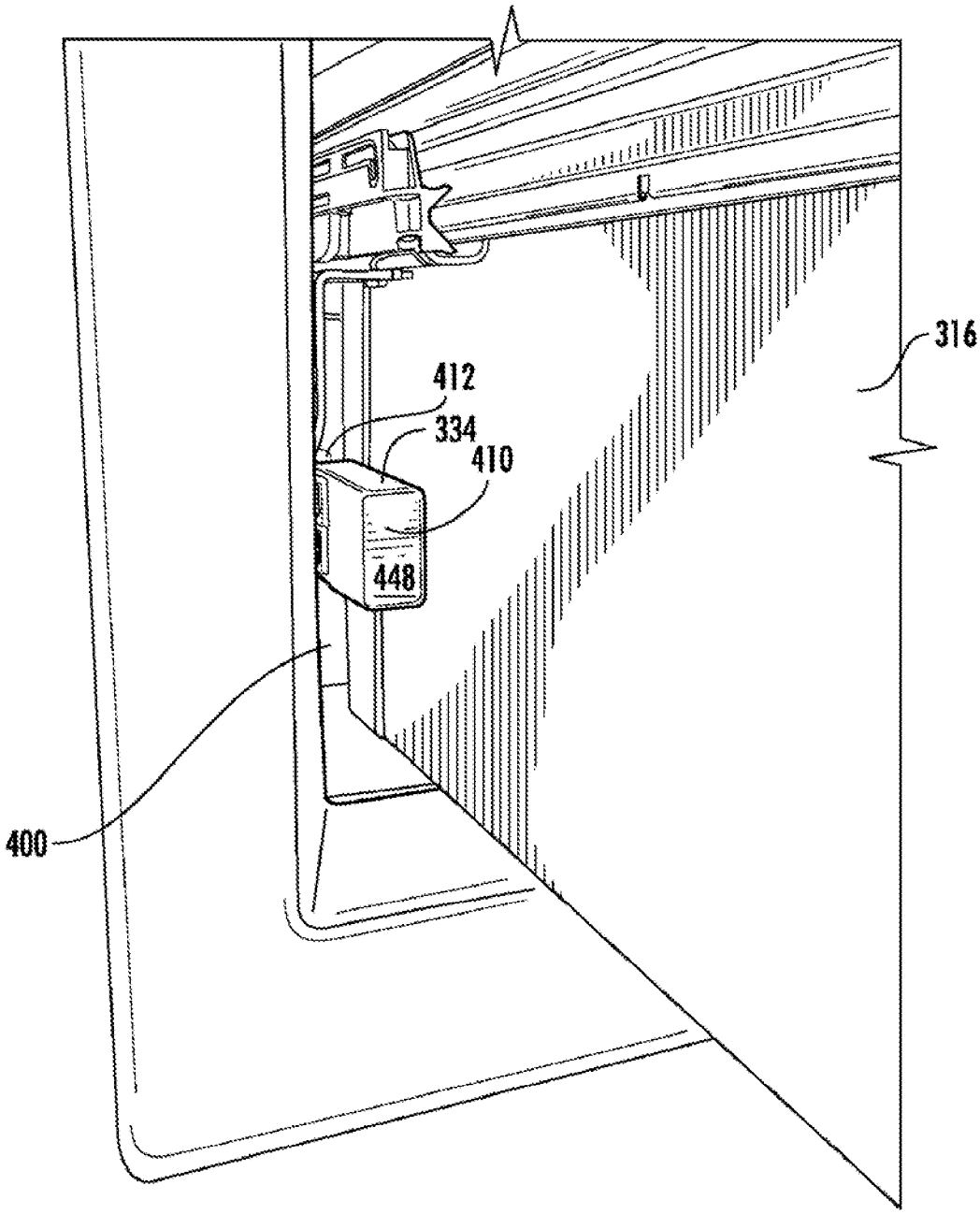
FIG. 15 is a partial side perspective view of the drawer of refrigerator of FIG. 12 and a drawer positioning device utilized therewith.
Figure 16A:
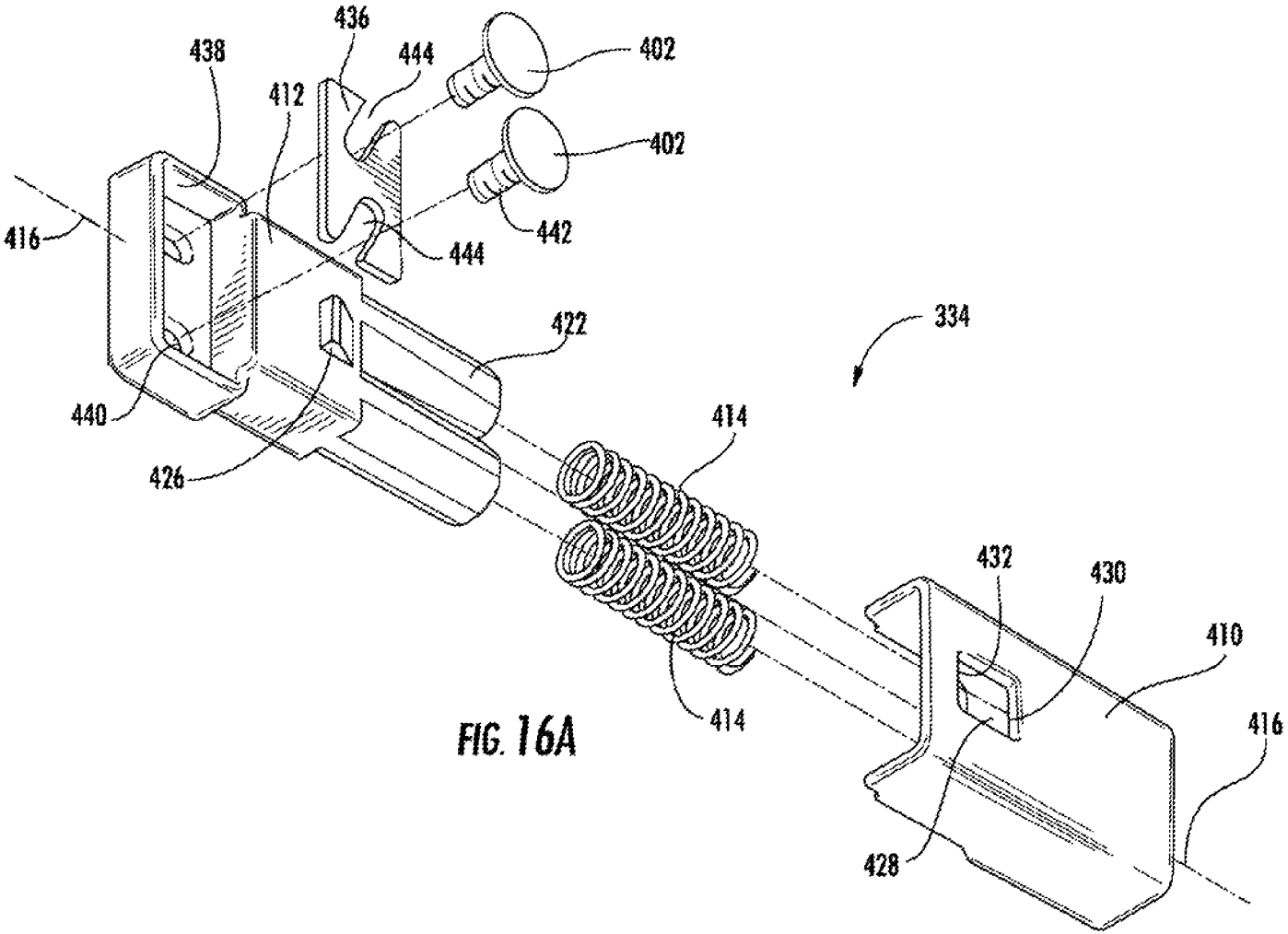
FIG. 16*a* is an exploded view of the drawer positioning device of FIG. 15.
Figure 16B:
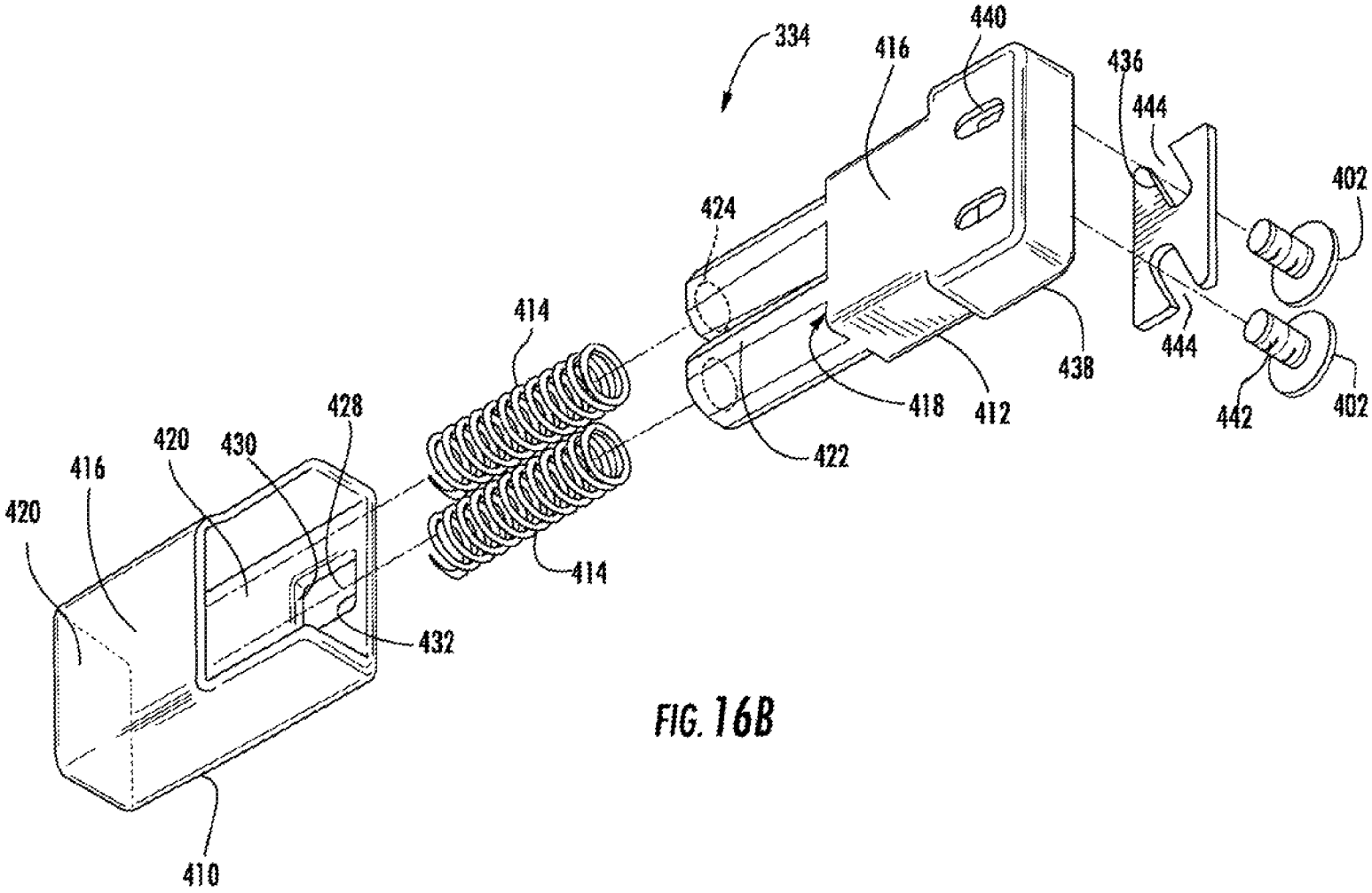
FIG. 16*b* is another exploded view of the drawer positioning device of FIG. 15.
Figure 17:
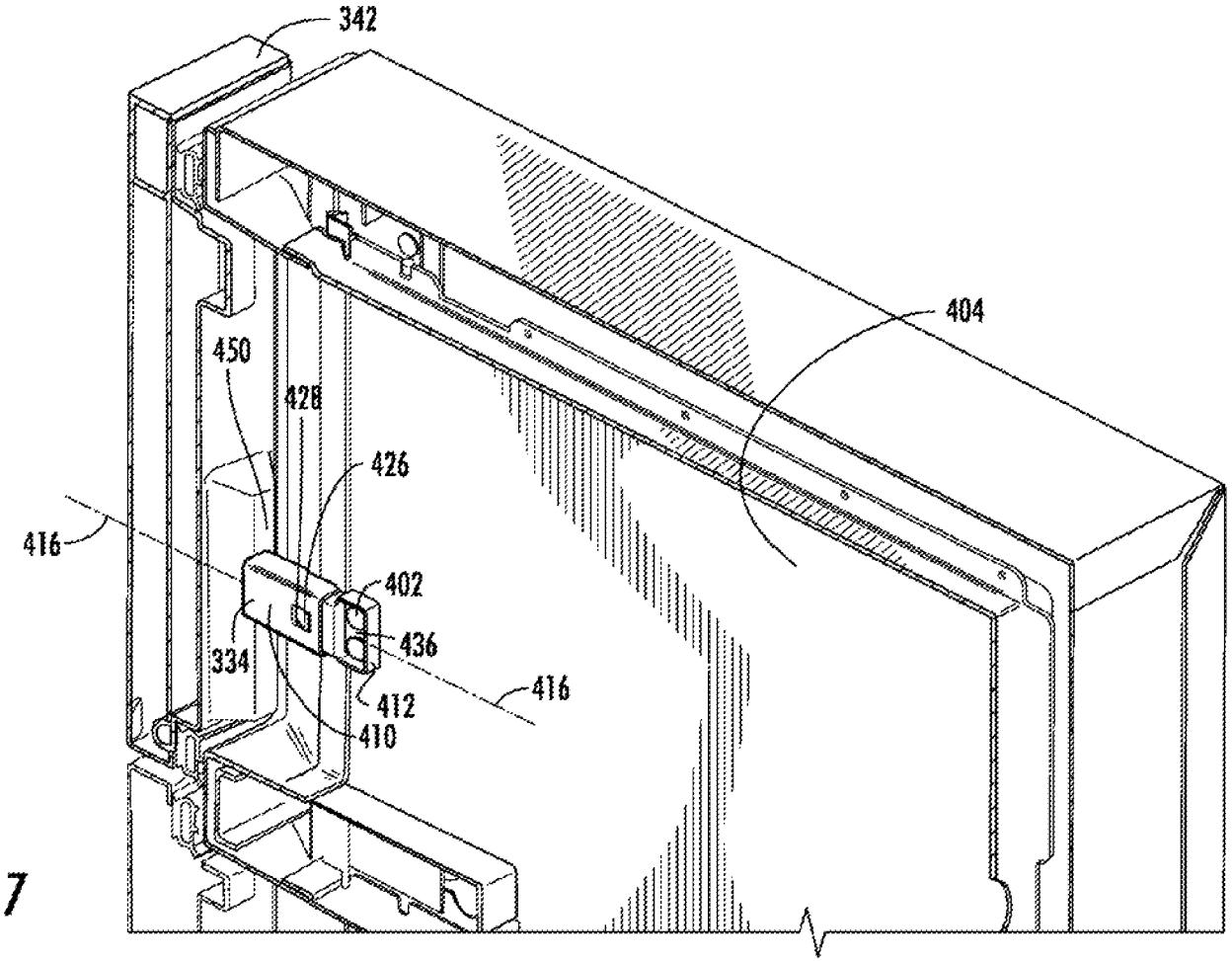
FIG. 17 is a perspective view of the drawer positioning device of FIG. 15 from within an internal cavity of a the refrigerator of FIG. 12.

Referring to FIGS. 15-17, drawer positioning devices 334 are utilized with drawers 316 according to an exemplary embodiment. Drawer positioning devices 334 are shown disposed within an internal cavity, shown as drawer cavity 400, defined by body 312 of refrigerator 310. One or more fastening elements, shown as threaded screws 402, are utilized to adjustably secure each drawer positioning device 334 relative to an internal side wall of the body 312. One drawer positioning device 334 is adjustably secured to a first internal side wall 404, while the other is adjustably secured to a second internal side wall 406 generally opposite the first internal side wall 404. In these positions, the restorative force applied by drawer positioning devices 334 to drawer 316 are substantially balanced. Though, it should be noted that, other suitable configurations may be used (e.g., varying the number and/or position of the positioning devices).

Further referring to FIGS. 15-17, each drawer positioning device 334 includes a first member 410, a second member 412, and one or more resilient members, shown as a pair of compression springs 414, according to an exemplary embodiment. Second member 412 is adjustably secured relative to the body 312 by screws 402, as described above, and first member 410 is slidably movable relative thereto. In the illustrated embodiment, second member 412 is nested within first member 410 to facilitate slidable movement of first member 410 relative to second member 412.

Referring to FIGS. 16*a* and 16*b*, compression springs 414 extend generally along or parallel to a first axis 416. Generally, compression springs 414 are configured to provide a biasing force to first member 410 and/or second member 142. First axis 416 is generally defined by the movement of first member 410 relative to second member 412. Further, when coupled to body 312, first axis 416 extends generally between front side 324 and rear side 326 of body 312 of refrigerator 310 according to an exemplary embodiment.

Compression springs 414 bias first member 410 forward (e.g., toward the front of the refrigerator) and are designed to have a certain spring force to bias door 14 to the home position from the over traveled position. Compression springs 414 are disposed generally between a first contact surface 418 and a second contact surface 420. In the illustrated embodiment, first contact surface 418 is a surface of first member 410 and is located proximate to the front of drawer 316 relative to second contact surface 420, which is a surface of second member 412. As first member 410 is moved relative to second member 412, the distance between first contact surface 418 and second contact surface 420 changes. As the distance between first contact surface 418 and second contact surface 420 changes, the distance compression springs 414 are compressed changes.

Referring further to FIGS. 16*a* and 16*b*, a pair of guides 422 are further provided to facilitate movement of compression springs 414 along or parallel to first axis 416 according to an exemplary embodiment. Guides 422 are shown generally elongated along or parallel to first axis 416. A pair of apertures 424 of guides 422 receive compression springs 414 in-part, guiding compression springs 414 generally toward first contact surface 418. According to other exemplary embodiments, features other than guides that are configured to facilitate and/or guide movement of the compression springs in a direction along or parallel to the first axis may be utilized in lieu of or in combination with the guides. According to still other exemplary embodiments, no features configured to facilitate movement of the compression springs in a direction along or parallel to the first axis are utilized; rather, simply positioning the compression springs between a first and second contact surface is sufficient.

Referring to FIGS. 16*a*-17, a tab 426 limits the range of motion of the first member 410 along first axis 416 and relative to second member 412 according to an exemplary embodiment. As compression springs 414 are retained between first contact surface 418 and second contact surface 420 in a constant state of compression, the tab 426 is intended to prevent first member 410 from separating from second member 412 (e.g., being pushed forward and off of the second member 412 as a result of the force applied by compression springs 414). Tab 426 is received in a slot 428 that extends generally front-to-back (e.g., in a direction generally parallel to first axis 416). When first member 410 is pushed rearward relative to second member 412, tab 426 may encounter a front wall 430 of slot 428, preventing tab 426 and, thus, first member 410 from continuing rearward. As first member 410 is biased forward, tab 426 may encounter a rear wall 432 of slot 428 (e.g., when drawer 316 is in the open position), preventing tab 426, and, thus, first member 410 from continuing forward. According to other exemplary embodiments, motion limiting features other than tabs and/or slots may be utilized to limit the range of motion of the first member along the first axis and/or relative to the second member.

Referring further to FIGS. 16*a*-17, drawer positioning devices 334 further include an adjustment element shown as a plate 436 according to an exemplary embodiment. Plate 436 may be utilized to adjust the position of second member 412 relative to its corresponding internal side wall, shown in FIG. 17 as first internal side wall 404 of drawer cavity 400. Plate 436 is received within a depressed portion 438 in second member 412 and is sized to be slightly smaller than depressed portion 438. A pair of apertures 440 (e.g., elongated slots) that receive screws 402 extend through depressed portion 438 and are each sized to be larger than shafts 442 of screws 402, allowing second member 412 to be movable relative to screws 402 when screws 402 are not fully tightened. Plate 436 is shown including a pair of generally diagonal slots 444 through which screws 402 extend before extending through depressed portion 438 and into first internal side wall 404. Diagonal slots 444 are configured to guide the movement of second member 412 relative to screws 402 when adjusting the position of second member 412 relative to first internal side wall 404 (e.g., to help ensure that in the home position the front of the cosmetic panel will be coplanar with its surroundings, etc.). Once second member 412 is in a desired position relative to first internal side wall 404, screws 402 can be fully tightened, applying pressure to plate 436 and there by to second member 412 to secure it relative to internal side wall 404. It should be noted that the position of second member 412 can also be adjusted when the screws 402 are substantially fully tightened by engaging plate 436 with a tool (e.g., a flathead screwdriver, etc.) to move plate 436, and thereby second member 412, relative to the internal side wall 404.

Referring generally to FIGS. 15-17, a front surface 448 of first member 410 contacts a rear surface 450 of drawer panel 342 when the drawer 316 is moved rearward from an open position to a closed position. Similar to positioning devices 24, drawer positioning devices 334 allow drawer 316 to move to an over travel position and then bias the drawer to a home position. In the home position, cosmetic panel 340 is substantially parallel to the face frame 328. In the over-travel position, cosmetic panel 340 is perpendicularly offset toward face frame 328 of body 312 relative to cosmetic panel 340 in the home position.

As discussed above, springs 414 are designed to have a certain spring force to bias door 314 to the home position from the over traveled position. If drawer 316 is moved to an over travel position, first member 410 is slidably moved rearward relative to an internal side wall of drawer cavity 400 and relative to second member 412. As first member 410 is slidably moved rearward, compression springs 414 are compressed in a direction along or parallel to first axis 416, accommodating the movement of drawer 316 beyond the home position. The compressed springs 414 then apply a force to first contact surface 418 that slidably moves first member 410 forward relative to second member 412. First member 410 then applies a force to drawer 316 until drawer 316 reaches the home position. When the drawer is in the home and the over travel positions, front surface 448 of first member 410 in contact with rear surface 450 of drawer panel 342. Front surface 448 is typically perpendicular to first axis 416.

Referring to FIGS. 12 and 18-19*b*, door positioning devices 336 are shown coupled to an interior surface 452 of door 314 of refrigerator 310 along handle side 322. In the exemplary embodiment shown, one door positioning device 336 is disposed proximate to the top of door 314 and the other door positioning device 336 is disposed proximate to the bottom of door 314. It should be noted that the door positioning devices 336 are coupled to door 314, rather than a face frame 328, to help conceal them (e.g., to a person looking into the refrigerator); however, the door positioning devices may be positioned at other suitable locations (e.g., coupled to the face frame etc.).

Figure 19A:
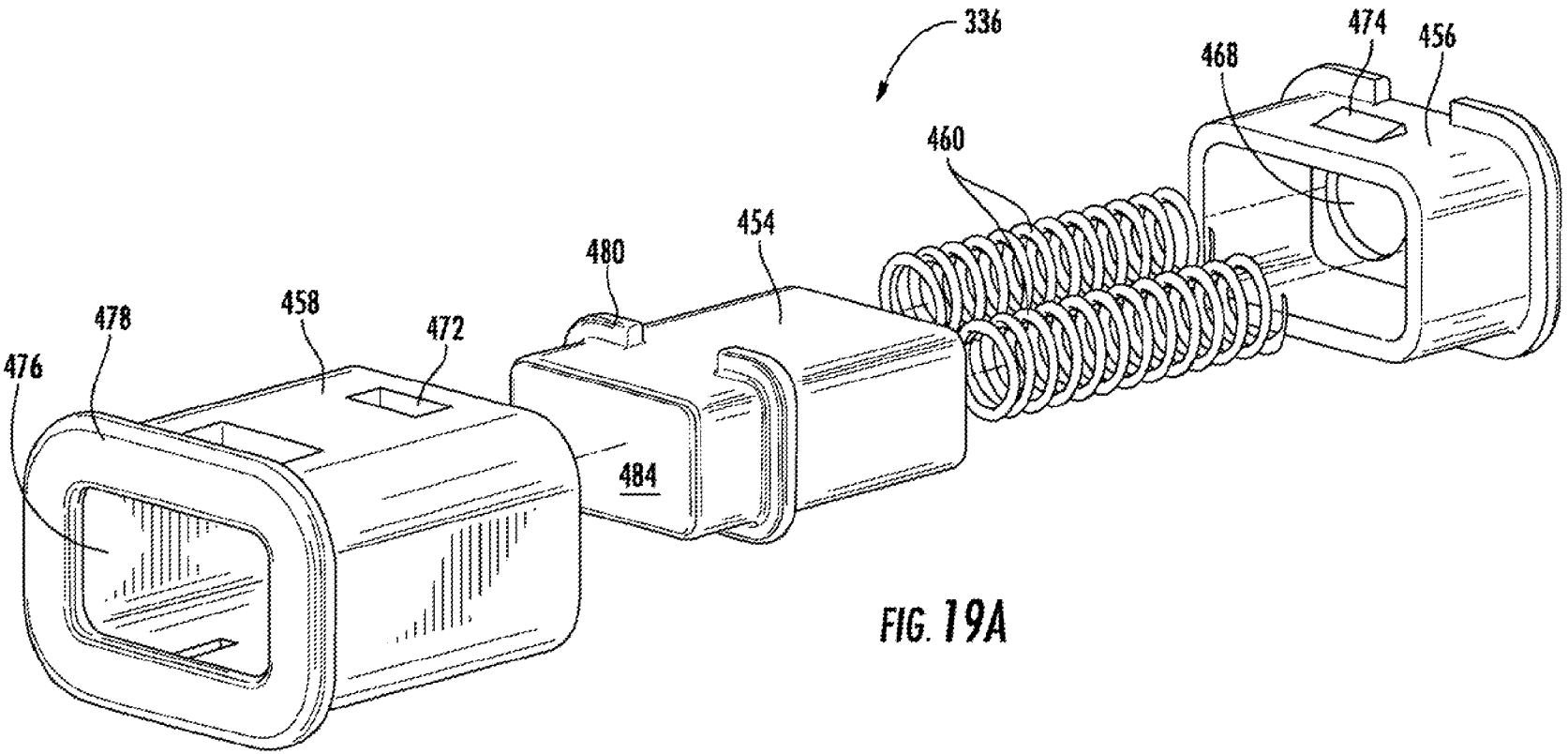
FIG. 19*a* is an exploded view of the door positioning device of FIG. 18.
Figure 19B:
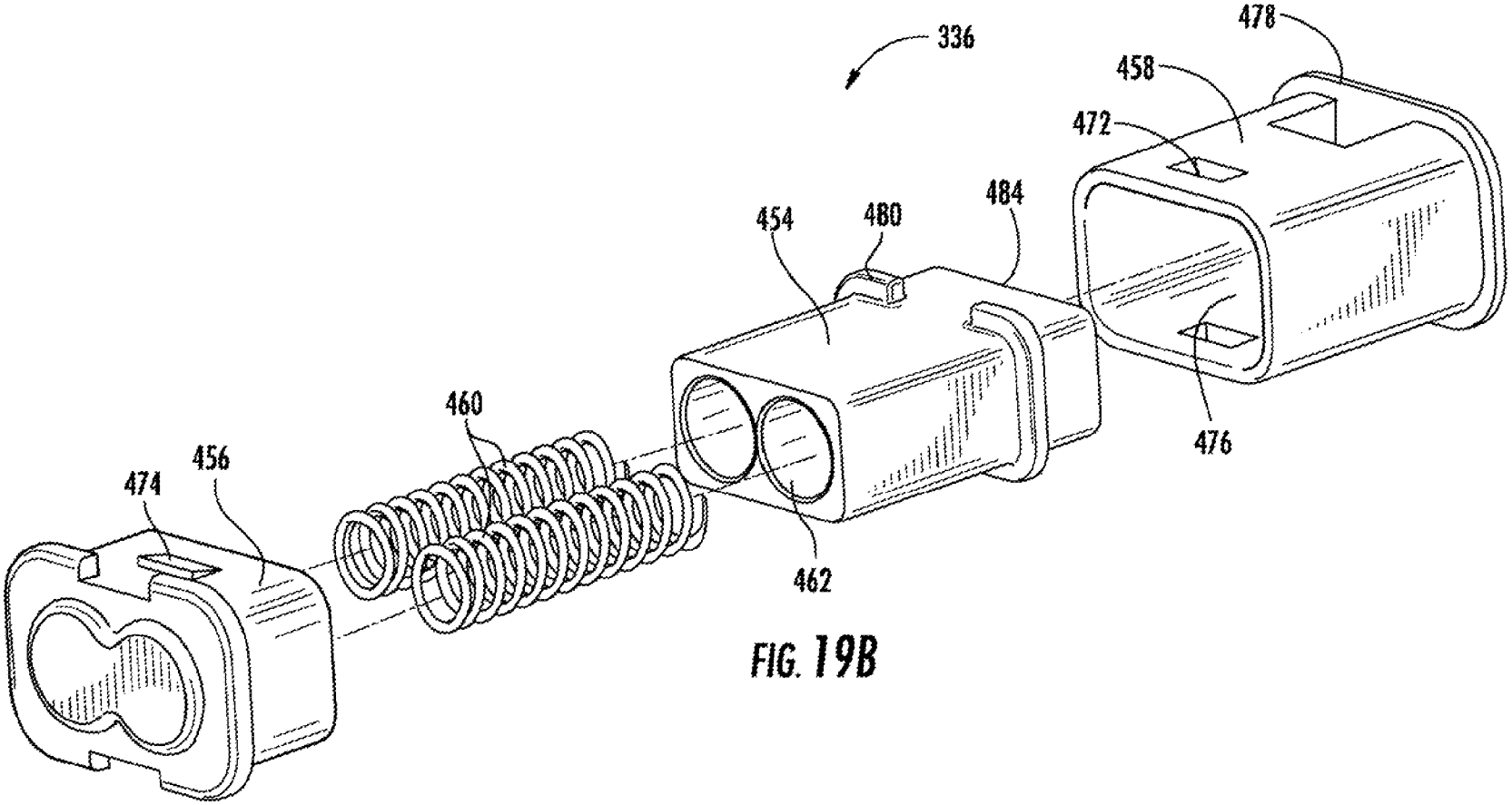
FIG. 19*b* is another exploded view of the door positioning device of FIG. 18.

Referring to FIGS. 19*a*-19*b*, each door positioning device 336 includes a first member 454, a second member 456, a housing 458, and one or more resilient members, shown as a pair of compression springs 460, according to an exemplary embodiment. Second member 456 is fixed relative to interior surface 452 of door 314 of refrigerator 310, and first member 454 is slidably movable relative thereto. In the embodiment shown, first member 454 is nested within the second member 456 to facilitate slidable movement relative thereto.

Springs 460 are configured to provide a biasing force to first member 454 and/or second member 456. Springs 460 are disposed within a pair of guides 462 and generally between a first contact surface of first member 454 and a second contact surface 468 of second member 456 according to an exemplary embodiment. Accordingly, similar to drawer positioning device 334, movement of first member 454 relative to second member 456 of door positioning device 336 compresses springs 460 along a second axis 470. When coupled to door 312, and when door 312 is closed, second axis extends generally front-to-back (i.e., generally between the front side and the rear side of the refrigerator), and, as illustrated here, generally parallel to the first axis 416. This compression causes springs 460 to bias first member 454 generally away from interior surface 452 of door (e.g., toward the rear or back side of the refrigerator when the door is closed).

Figure 18:
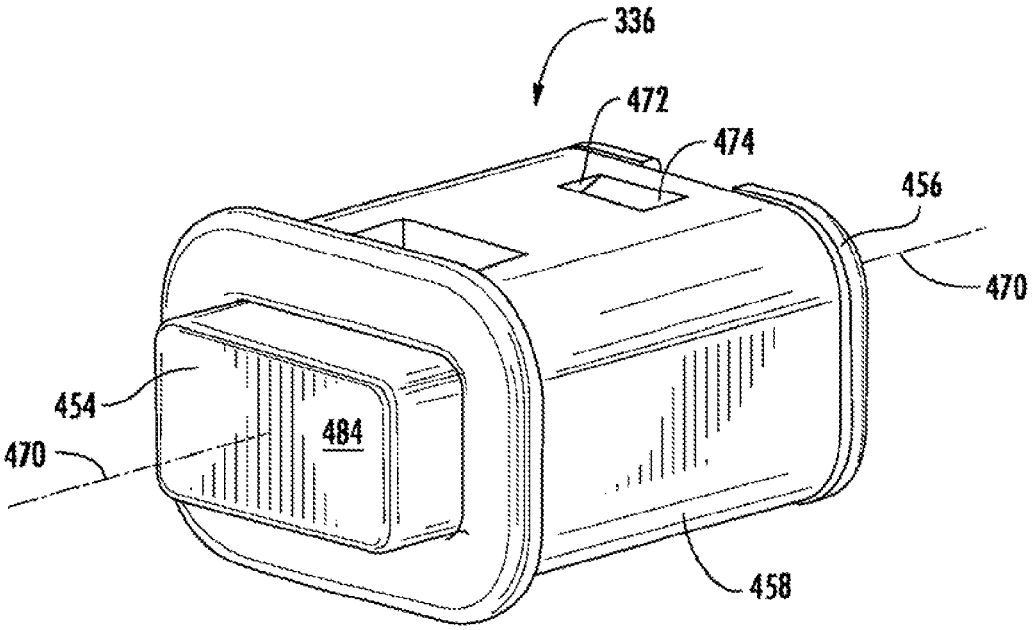
FIG. 18 is a perspective view of a door positioning device according to an exemplary embodiment.

Referring to FIGS. 18-19*b*, first member 454 and second member 456 are at least partially received within housing 458 according to an exemplary embodiment. Housing 458 is shown including an aperture 472 that interacts with a tab 474 of second member 456 to help secure the second member 456 thereto.

Referring further to FIGS. 18-19*b*, housing 458 further includes an opening 476 at a front side 478 according to an exemplary embodiment. First member 454 typically extends partially through opening 476 in order to encounter face frame 328 of body 312 of refrigerator 310. First member 454 includes a projection 480 configured to help prevent it from moving too far through opening 476. Projection 480 is intended to encounter an internal surface of housing 458 to limit movement of first member 454 along second axis 470 and generally away from interior surface 452 of door (e.g., by providing a counter force to the bias force provided by springs 460). By limiting the range of motion of first member 454 along second axis 470, projection 480 helps prevent first member 454 from separating from second member 456 and helps maintain springs 460 in a constant state of compression, biasing first member 454 toward the home position. Movement of first member 454 generally toward interior surface 452 of door is limited by the interaction of first member 454 and second member 456.

Figure 12:
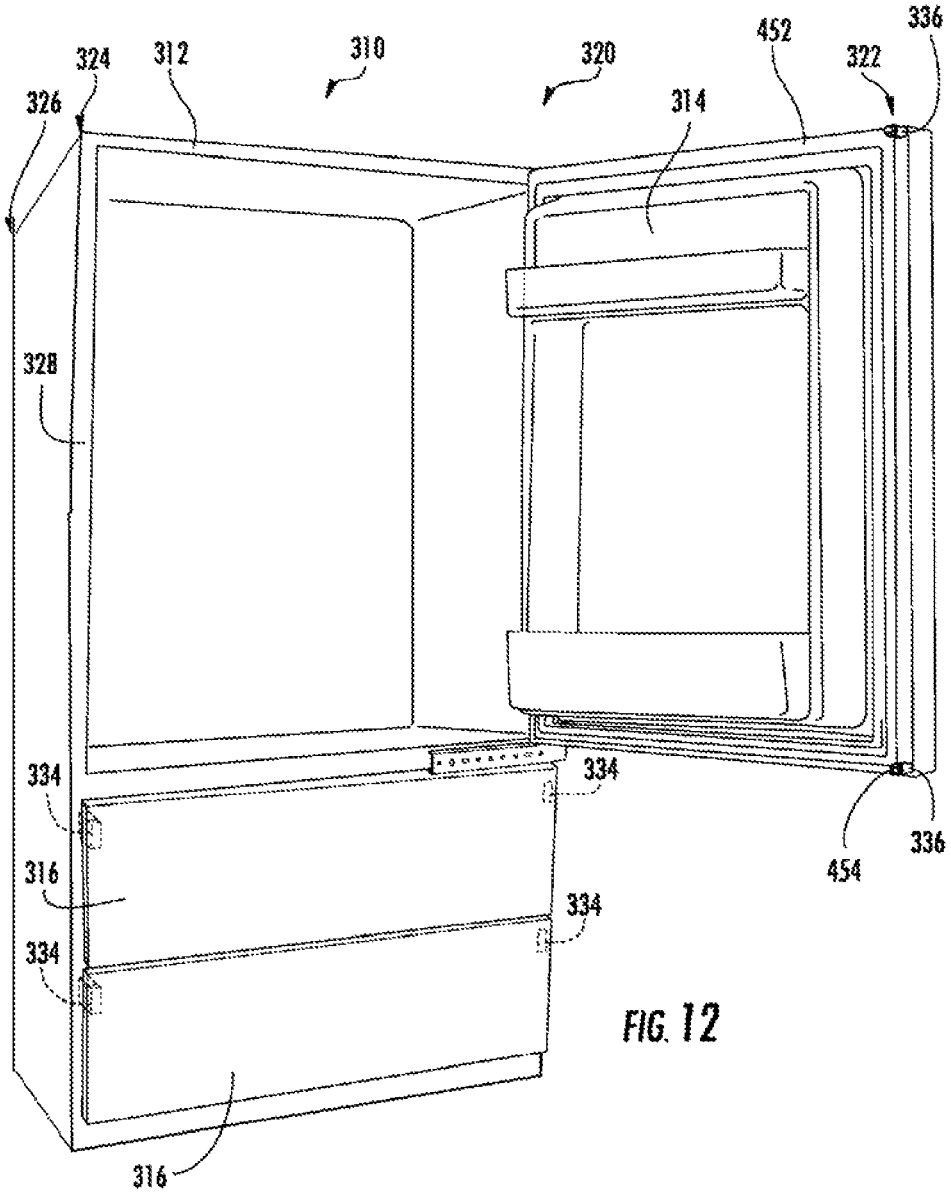
FIG. 12 is a front view of another exemplary embodiment of a refrigerator.

Referring generally to FIGS. 12 and 19-20, door positioning devices 336 function similar to drawer positioning devices 334, allowing door 314 of refrigerator 310 to move to an over travel position and then biasing door 314 to a home position. In the home position, cosmetic panel 340 is substantially parallel to face frame 328. In the over-travel position, cosmetic panel 340 is angled toward face frame 328 of body 312 relative to cosmetic panel 340 in the home position.

As discussed above, springs 460 are designed to have certain spring force to bias door 314 to the home position from the over traveled position. If door 314 is moved to an over travel position, first member 454 is slidably moved generally forward, further into second member 456, as it encounters face frame 328 and springs 460 are further compressed. The compressed springs 460 then apply a generally rearwardly-directed force to first member 454 that slidably moves first member 454 rearward and further out of housing 458. A front surface 484 of first member 454 in contact with face frame 328 of body 312. Moving first member 454 generally rearward also causes second member 456 and door 314 coupled thereto to move generally away from face frame 328 until door 314 reaches the home position under the bias of springs 460.

According to any exemplary embodiment, a door or door positioning device may have any configuration wherein a first member is slidably movable relative to a second member and one or more resilient members are configured to bias the first member from an over travel position to a home position.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It is important to note that the construction and arrangement of the refrigerator and the various components thereof as shown in the various exemplary embodiments is illustrative only (and such term is not intended to connote that such embodiments are necessarily extraordinary or superlative examples). Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements (e.g., bracket or installation fixture may comprise multiple sub-components), the position of elements may be reversed or otherwise varied, and the nature or number of discrete elements or positions may be altered or varied (e.g., a greater or lesser number of positioning devices may be included, the position and orientation of each positioning device within and along the cabinet bracket may be varied, etc.). Also, while this disclosure is generally directed to refrigerators, the teachings contained herein may extend to various other types of appliances, such as freezers, ovens, stove units, microwave units, dishwasher units, or the like. Also, some elements of the disclosure may be applicable to devices other than appliances (e.g., one or more positioning devices may be incorporated into any device having a door or other element movable relative to a body). Accordingly, all such modifications are intended to be included within the scope of the present invention as defined in the appended claims.

The order or sequence of any process or method steps may be varied or resequenced according to alternative embodiments. In the claims, any means-plus-function clause is intended to cover the structures described herein as performing the recited function and not only structural equivalents but also equivalent structures. Other substitutions, modifications, changes, and omissions maybe made in the design, operating conditions, and arrangement of the exemplary embodiments without departing from the scope of the present inventions as expressed in the appended claims.

What is claimed is:

1. An appliance, comprising:

a body having a front surface;

a panel movable relative to the body between a first position, a second position, and a third position, wherein the third position is located between the first position and the second position; and a positioning device configured to bias the panel to the third position when in the second position, the positioning device comprising a first member slidably moveable relative to a second member; and a first resilient member configured to provide a biasing force to the first member or to the second member or to both the first member and the second member;

wherein the panel in the first position is perpendicularly offset toward the front surface of the body relative to the panel in the third position.

2. The appliance of claim 1, wherein the positioning device is disposed within an internal cavity defined by the body.

3. The appliance of claim 1, wherein, in the third position, the panel is substantially parallel to the front surface of the body.

4. The appliance of claim 1, wherein the panel in the second position is angled toward the front surface of the body relative to the panel in the third position.

5. The appliance of claim 1, wherein the second member is adjustably fixed relative to the body.

6. The appliance of claim 5, wherein the positioning device further includes an adjustment element, the adjustment element configured to be engaged by a tool to move the second member relative to the body.

7. The appliance of claim 5, wherein the second member is adjustably fixed relative to an internal side wall of the body.

8. The appliance of claim 1, wherein the first member and the second member are nested.

9. The appliance of claim 8, wherein the first member is nested within the second member.

10. The appliance of claim 8, wherein the second member is nested within the first member.

11. The appliance of claim 1, wherein the body comprises a front side substantially opposite a rear side, and wherein the first member of the positioning device is slidable along a first axis, the first axis extending substantially front-to-back when the panel is in the third position.

12. The appliance of claim 11, wherein a front surface of the first member is configured to be in contact with a rear side of the panel when the panel is in the second position and the third position, the front surface being substantially perpendicular to the first axis.

13. The appliance of claim 11, wherein a front surface of the first member is configured to be in contact with a front surface of the body when the panel is in the second position and the third position.

14. The appliance of claim 11, wherein the positioning device further comprises a motion restricting element that limits the distance the first member can travel along the first axis.

15. The appliance of claim 1, wherein the panel is one of a door panel and a drawer panel.

16. The appliance of claim 1, further comprising:

the body further including a front side substantially opposite a rear side and a top side substantially opposite a bottom side;

a second panel configured to be coupled to the panel; and a direct mount installation system for coupling the second panel to the panel, the direct mount installation system comprising:

a first bracket coupled to a first side wall of the panel, a first side of the first bracket extending laterally outward from the first side wall;

a second bracket coupled to a second side wall of the panel, a first side of the second bracket extending laterally outward from the second side wall, wherein the first sides of the first bracket and the second bracket each further include a plurality of coupling features, the coupling features being spaced apart along the first sides of the first bracket and the second bracket from top to bottom.

17. The appliance of claim 16, wherein the first bracket and the second bracket are configured to remain coupled to the panel during coupling of the second panel to the panel.

18. The appliance of claim 16, further comprising an adjustment system including one or more cams configured to move the first and second brackets relative to the panel.

19. The appliance of claim 16, wherein the coupling features are apertures, and wherein one or more supporting elements may be disposed through one or more of the apertures to support the second panel relative to the panel in order to facilitate coupling the second panel to the panel.

20. The appliance of claim 16, further comprising a plurality of fasteners configured to be received through one or more of the apertures of each of the first bracket and the second bracket to fix the second panel relative to the first bracket and the second bracket.

21. The appliance of claim 16, wherein the first bracket and the second bracket each include a second side, the second side of the first bracket being disposed adjacent and substantially parallel to the first side wall of the panel and the second side of the second bracket being disposed adjacent and substantially parallel to the second side wall of the panel.

22. An appliance, comprising:

a body having a front surface;

a panel movable relative to the body between a first position, a second position, and a third position, wherein the third position is located between the first position and the second position; and a positioning device configured to bias the panel to the third position when in the second position, the positioning device comprising a first member pivotally coupled to a second member at a pivot point; and a first resilient member configured to provide a biasing force to the first member or to the second member or to both the first member and the second member;

wherein the panel in the first position is perpendicularly offset toward the front surface of the body relative to the panel in the third position.

23. The appliance of claim 22, wherein the pivot point is substantially fixed relative to the body.

24. The appliance of claim 22, wherein the panel is substantially parallel to the front surface of the body when in the third position, and wherein the panel in the second position is angled toward the front surface of the body relative to the panel in the third position.

25. The appliance of claim 22, wherein the positioning device is pivotally coupled within a bracket and the first member and the second member include pads extending through the bracket to operatively contact the panel.

26. The appliance of claim 22, wherein the first member and the second member each have a second end a greater distance from the panel than a first end, the first resilient member being coupled between the first end of the first member and the second end of the second member.

27. The appliance of claim 26, wherein the first resilient member is compressed a greater distance in the second position than in the third position.

28. The appliance of claim 26, further comprising a second resilient member coupled between the first end of the second member and the second end of the first member.

* * * * *